US006014071A

United States Patent [19]

Onishi et al.

[11] Patent Number: 6,014,071

[45] Date of Patent: Jan. 11, 2000

[54] CHOKE COIL

[75] Inventors: Kazuaki Onishi; Hidenori Uematsu; Tsunetsugu Imanishi, all of Matsusaka; Munekazu Sato, Hirakata, all of Japan

[73] Assignee: Matsushita Electric Industrial Co., Ltd., Osaka, Japan

[21] Appl. No.: 09/096,609

[22] Filed: Jun. 12, 1998

Related U.S. Application Data

[62] Division of application No. 08/553,506, Nov. 30, 1995, Pat. No. 5,841,335.

[30] Foreign Application Priority Data

Apr. 26, 1994 [JP] Japan ..... 6-088313

[51] Int. Cl.[7] ..... H01F 27/24; H01F 27/28

[52] U.S. Cl. ..... 336/170; 336/214; 336/234; 336/215; 336/178

[58] Field of Search ..... 336/234, 214, 336/184, 110, 178, 215, 170, 182, 232

[56] References Cited

U.S. PATENT DOCUMENTS

| | | | |
|---|---|---|---|
| 3,201,731 | 8/1965 | Baenziger et al. | 336/212 |
| 4,009,460 | 2/1977 | Fukui et al. | 336/110 |
| 5,481,238 | 1/1996 | Carsten et al. | 336/214 |
| 5,671,526 | 9/1997 | Merlano | 29/609 |

FOREIGN PATENT DOCUMENTS

| | | | |
|---|---|---|---|
| 1034220 | 4/1978 | China | 336/184 |
| 2215547 | 9/1989 | European Pat. Off. . | |
| 0579962 | 1/1994 | European Pat. Off. . | |
| 0580131 | 1/1994 | European Pat. Off. . | |
| 38-14910 | 7/1963 | Japan . | |
| 51-137868 | 11/1976 | Japan . | |
| 64-53513A | 3/1989 | Japan . | |
| 2-503251A | 10/1990 | Japan . | |
| 4-80022 U | 7/1992 | Japan . | |
| 4-133415 U | 12/1992 | Japan . | |
| 5-41121 U | 6/1993 | Japan . | |
| 5-77921 U | 10/1993 | Japan . | |
| 5-82034 U | 11/1993 | Japan . | |

OTHER PUBLICATIONS

Patent Abstracts of Japan vol. 004, No. 175 (E–036), Dec. 3, 1980 & JP–A–55 120117 (Toshiba Corp.), Sep. 16, 1980.

*Primary Examiner*—Michael L. Gellner
*Assistant Examiner*—Anh Mai
*Attorney, Agent, or Firm*—Stevens, Davis, Miller & Mosher, L.L.P.

[57] ABSTRACT

A choke coil for preventing harmonic distortions having a plurality of laminated iron core sheets formed into a core. A first coil is wound around a first limb of a first core, and a second coil is wound around a first limb of a second core. A third coil is wound around the second limb of both the first core and the second core, and the second core is disposed within the magnetic circuit of the first magnetic core. The iron core sheets have embossments formed on a front and back side for fitting the iron core sheets together. The embossments have longitudinal sides formed orthogonally to the direction of magnetic fluxes in the core, and may be inwardly inclined to face each other.

9 Claims, 34 Drawing Sheets

CHOKE COIL

This appln. is a Divisional of Ser. No. 08/553,506 filed on Nov. 30, 1995, now U.S. Pat. No. 5,841,335.

TECHNICAL FIELD

The present invention relates to a choke coil used for preventing harmonic distortions, or improving the power factor of home-use and industrial electronic apparatuses.

BACKGROUND ART

In recent years, in order to decrease the size and increase the performance of industrial equipment and home-use apparatuses, the use of devices incorporating semiconductor applications has been expanding. The power rectifier circuit and the phase control circuit built in such devices use a capacitor. The large pulse-like input current for charging the capacitor increases the high-harmonic current and voltage distortion in the transmission line and the power equipment. The devices are thus adversely affected and the power factor thereof is reduced considerably. Various methods have been suggested for suppressing the high-harmonic current and improving the power factor. Of all these methods, a comparatively simple and low-cost method is closely watched in which a choke coil is inserted in series (in normal mode) in the AC line.

A conventional choke coil for preventing harmonic distortions shown in FIGS. 32 to 34 is well known. FIGS. 32 to 34 show an exploded perspective view, a sectional view and an equivalent circuit respectively of a conventional choke coil used for preventing harmonic distortions.

In FIGS. 32 to 34, numeral 58 designates a U-shaped closed-circuit magnetic core made of a ferrite material, numeral 59 an EI-shaped closed-circuit magnetic core made of silicon steel sheets, numeral 60 a bobbin, numerals 61, 62 coils, numeral 63 a resin case, numeral 64 a shield case, numeral 65 a casting resin, numeral 66 partitioning flanges, numeral 67 a magnetic gap, character "C" a common-mode choke coil section and character "N" a normal-mode choke coil section.

The above-mentioned choke coil for preventing harmonic distortions is completed by combining the U-shaped closed-circuit magnetic core 58 of a ferrite material and the EI-shaped closed-circuit magnetic core 59 of silicon steel sheets, with the coils 61, 62 having the same number of turns wound on the bobbin 60 partitioned by the partitioning flange 66 in such a manner as to cover two magnetic cores 58, 59. In this configuration, as shown by the equivalent circuit of FIG. 34, two different closed-circuit magnetic cores 58, 59 constitute different magnetic circuits, and the normal-mode choke coil section "N" is configured mainly of the EI-shaped closed-circuit magnetic core 59 of silicon steel sheets while the common-mode choke coil section "C" is constructed mainly of the U-shaped closed-circuit magnetic core 58 of a ferrite material. The magnetic gap 67 provided on the middle limb of the EI-shaped magnetic core 59 made of silicon steel sheets is for improving the magnetic saturation characteristic of the normal-mode choke coil section "N".

For a choke coil for preventing harmonic distortions, the important problem is generally how to secure a very large inductance value on the order of several mH in normal mode and reduce the package space and weight at the same time. The conventional choke coil for preventing harmonic distortions shown in FIG. 32 can secure a normal-mode inductance value required for preventing harmonic distortions, while at the same time having the function of a common-mode choke coil. Therefore, prevention of both harmonic distortions and EMI is possible, and also the common-mode choke coil thus far arranged in the filter block of the power circuit can be eliminated, thereby leading to the additional advantage of reducing the package space.

In the conventional choke coil for preventing harmonic distortions, however, due to the configuration of the magnetic circuit thereof, the coil 61 and the coil 62 cannot be arranged closely to each other and are separated by the width of the middle limb of the EI-shaped magnetic core 59 of silicon steel sheets. As a result, the coupling coefficient between the coils 61 and 62 of the common-mode choke coil section "C" is reduced, so that the magnetic core 58 of a ferrite material is liable to be magnetically saturated. It is thus necessary to select a material of a high saturation flux density for the magnetic core 58. Generally, materials of a high saturation flux density have a low magnetic permeability, leading to the disadvantage of an increased size of the common-mode choke coil section "C". Also, in the normal-mode choke coil section "N", a great amount of leakage fluxes are generated from the magnetic gap 67 provided on the middle limb of the EI-shaped magnetic core 59 of silicon steel sheets, thereby posing the problem of an adverse effect on the other parts.

DISCLOSURE OF INVENTION

In order to solve the above-mentioned problem, a choke coil according to the present invention comprises a first magnetic core and a second magnetic core making up a closed magnetic circuit or an open magnetic circuit, a first coil, a second coil and a third coil, wherein the first coil is wound on the first magnetic core, the second coil is wound on the second magnetic core, and the third coil is wound in such a manner as to cover at least portions of the first and second magnetic cores.

As described above, the third coil is wound in such a manner as to cover the first and second magnetic cores, and therefore the coupling coefficient between coils becomes high in the common-mode choke coil section "C". As a result, the common-mode choke coil section "C" can be reduced in size. In the normal-mode choke coil section "N", on the other hand, the leakage fluxes generated from the magnetic gap can be blocked by coils. Thus, a compact choke coil for preventing harmonic distortions having the function of a high-performance common-mode choke coil can be provided with low cost and high quality.

BEST MODE FOR CARRYING OUT THE INVENTION (Embodiment 1)

Figure 1:
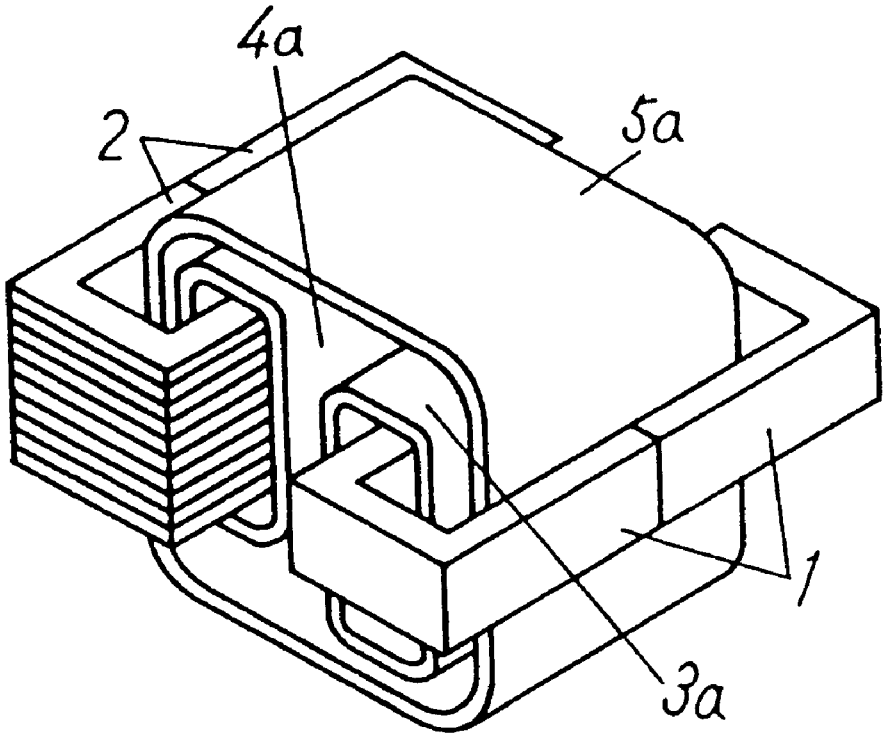
FIG. 1 is a model perspective view of a choke coil according to an embodiment of the present invention.
Figure 2:
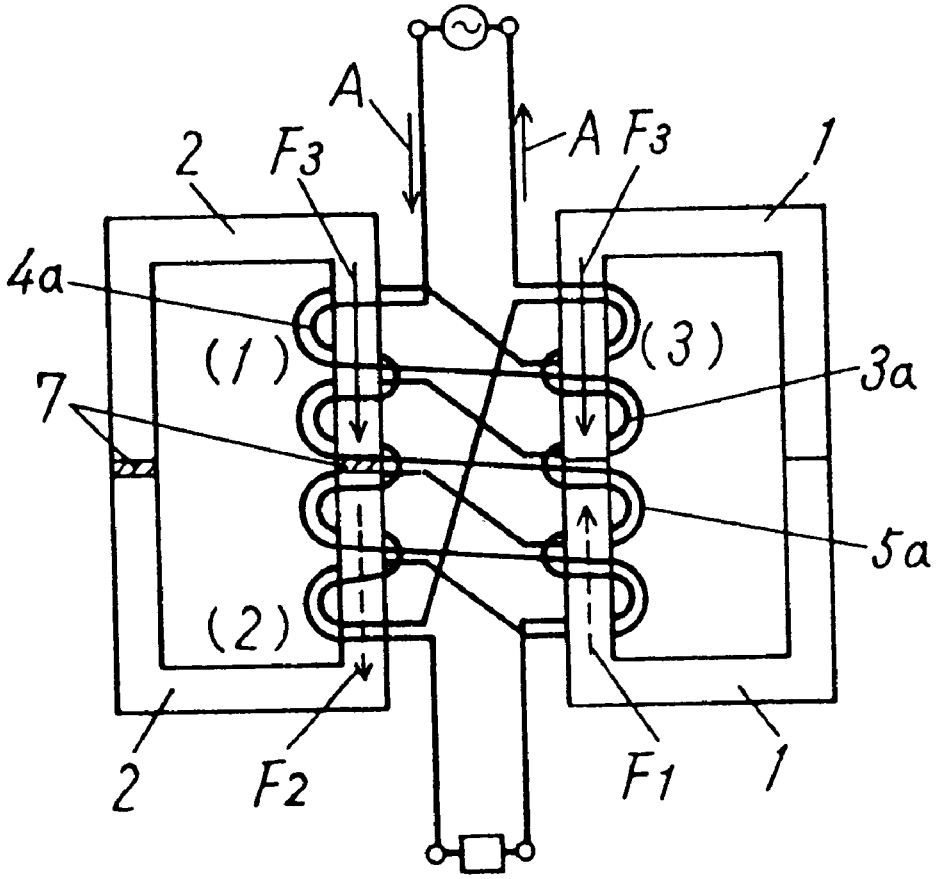
FIG. 2 is a diagram showing a magnetic circuit of the same embodiment.
Figure 3:
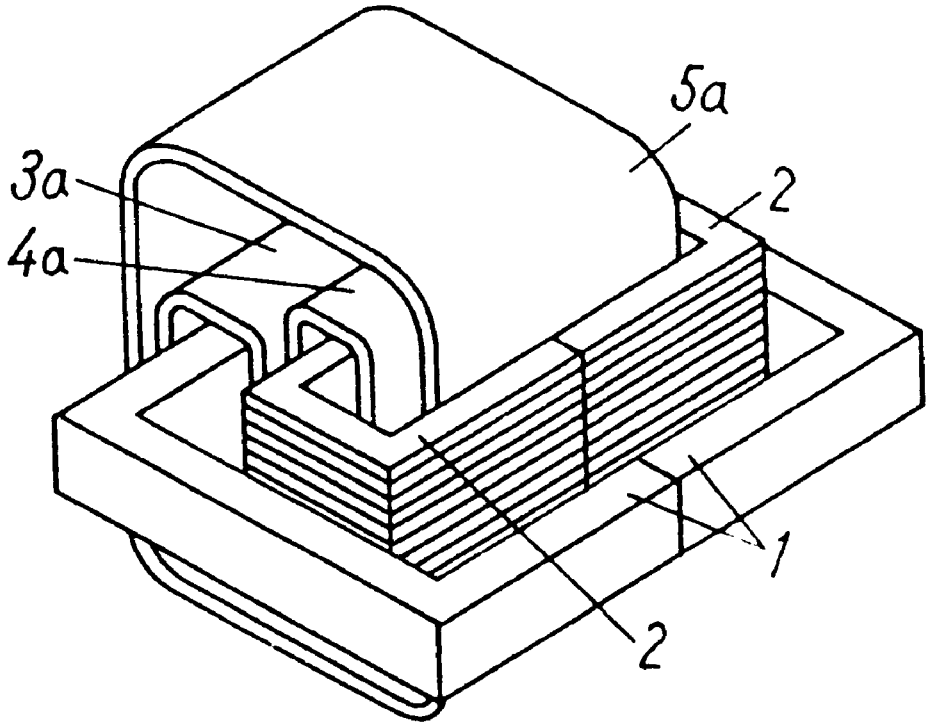
FIG. 3 is a model perspective view of a development example of the embodiment shown in FIG. 1.
Figure 32:
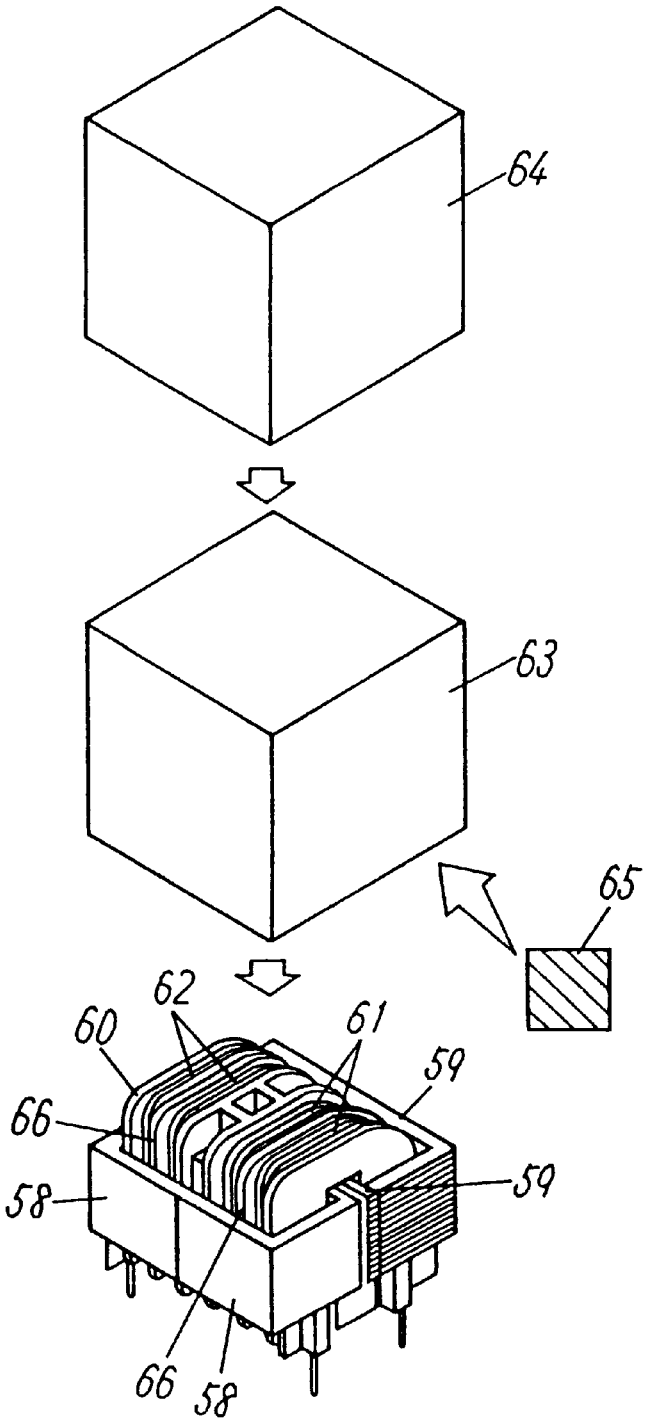
FIG.32 PRIOR ART
FIG. 32 is an exploded perspective view of a conventional choke coil.
Figure 33:
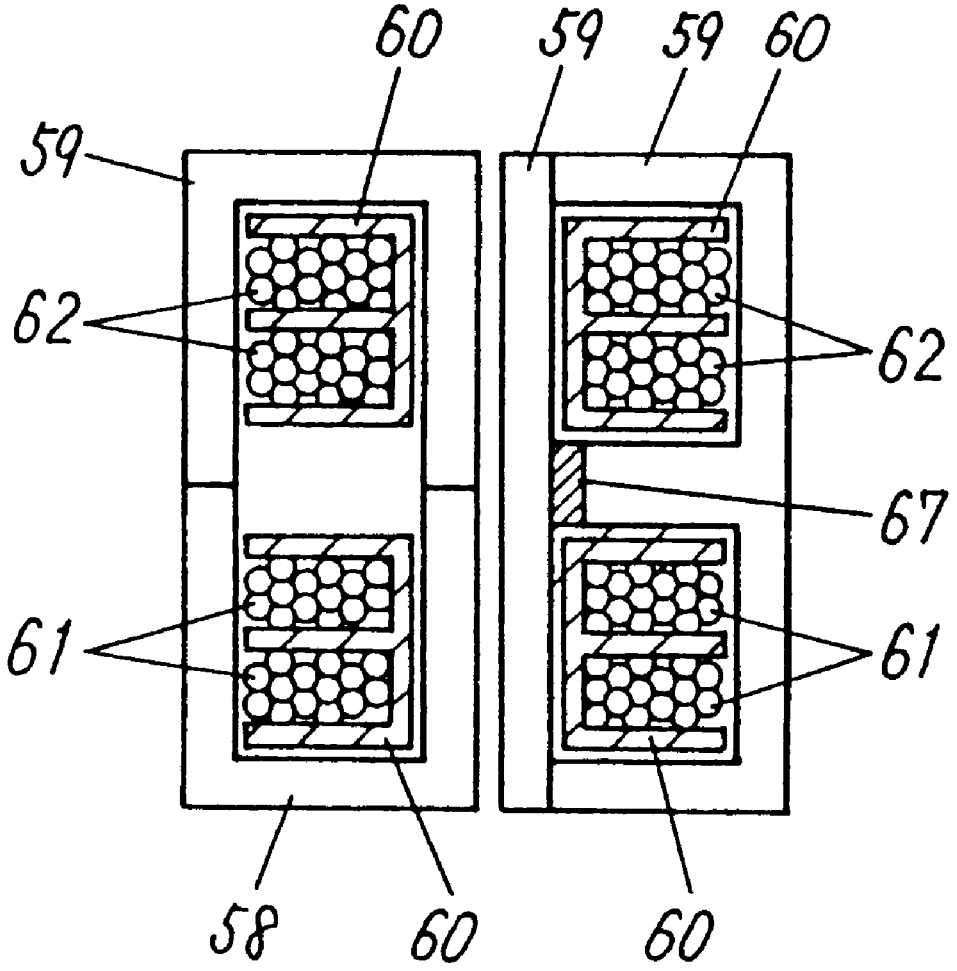
FIG.33 PRIOR ART
FIG. 33 is a sectional view of the same choke coil.
Figure 34:
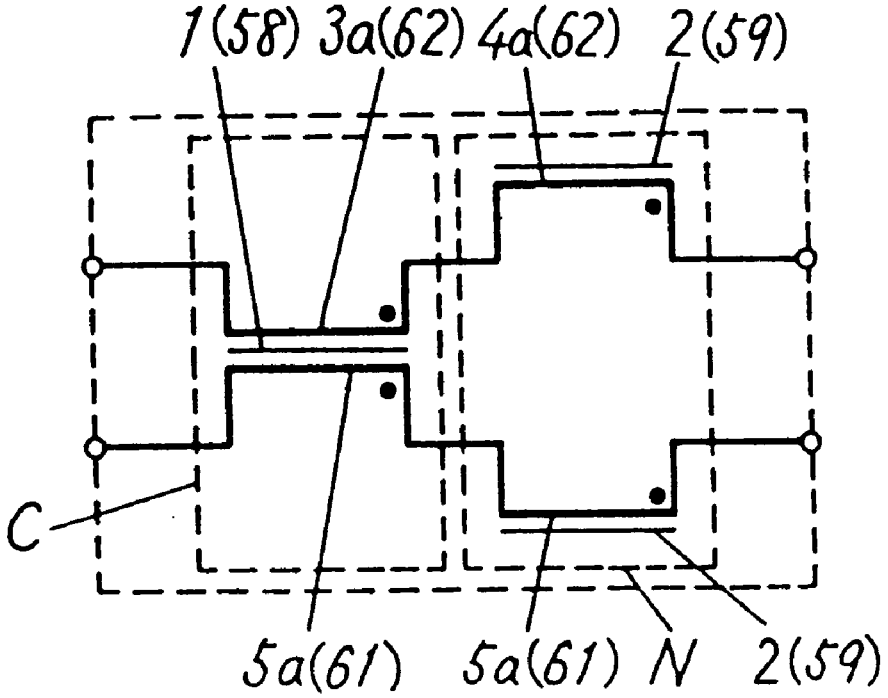
FIG.34 PRIOR ART
FIG. 34 is a diagram showing an equivalent circuit of the same embodiment.

An embodiment of the invention is described below with reference to the accompanying drawings. In FIGS. 1 to 3, those component parts having the same configuration as the conventional circuits shown in FIGS. 32, 33 and 34 are denoted by the same reference numerals respectively and will not be described again. First, a model perspective view of a choke coil for preventing harmonic distortions, a magnetic circuit thereof and a model perspective view of a development example of the embodiment of FIG. 1 are shown respectively in FIGS. 1 to 3. In FIGS. 1 to 3, numeral 1 designates a first magnetic core providing a single-rectangle-shaped closed-circuit magnetic core made of a U-shaped ferrite material, numeral 2 a second magnetic core providing a single-rectangle-shaped magnetic circuit core made of U-shaped silicon steel sheets, numeral 3*a* a first coil, numeral 4*a* a second coil, numeral 5*a* a third coil, numeral 7 a magnetic gap, character "A" a line current, character $F_1$ magnetic fluxes generated by the first coil 3*a*, character $F_2$ magnetic fluxes generated by the second coil 4*a*, and character $F_3$ magnetic fluxes generated by the third coil 5*a*.

The configuration of the first embodiment is described in detail. First, the first coil 3*a* is wound on one of the limbs of the first magnetic core 1, and the second coil 4*a* on one of the limbs of the second magnetic core 2. Further, the third coil 5*a* is wound between the limbs in such a manner as to cover the first coil 3*a* and the second coil 4*a*. The partitioned winding may be employed as a winding method in order to improve the high frequency characteristics.

The first coil 3*a* wound on one of the limbs of the first magnetic core 1 and the third coil 5*a* wound on the first coil 3*a* are positioned in such a direction that the magnetic fluxes $F_1$ and $F_3$ are offset with each other in the particular limb with respect to the line current "A", thereby configuring a common-mode choke coil section "C" similar to the equivalent circuit of FIG. 34 described with reference to the prior art. Also, the second coil 4*a* wound on one of the limbs of the second magnetic core 2 and the third coil 5*a* wound on the second coil 4*a* have the magnetic fluxes $F_2$ and $F_3$ thereof positioned in such a direction as not to be offset with each other in the particular limb with respect to the line current "A", thereby mainly constituting a normal-mode choke coil section "N" similar to the equivalent circuit of FIG. 34 described with reference to the prior art. The circuit according to the embodiment is completed by connecting the first coil 3*a* and the second coil 4*a*. The butted surface of one of the limbs of the second magnetic core 2 may be provided with a magnetic gap for improving the normal-mode magnetic saturation characteristic.

As described above, according to the embodiment under consideration, the equivalent circuit of the invention can be configured of the same circuit as the conventional equivalent circuit shown in FIG. 34. Therefore, the same normal-mode inductance value required for a choke coil for preventing harmonic distortions can be secured as in the prior art while at the same time providing the function of a common-mode choke coil. For this reason, EMI as well as harmonic distortions can be prevented, and the common-mode choke coil thus far provided in the filter block of the power circuit can be eliminated, resulting in a reduced package space.

Further, with the common-mode choke coil section "C" according to the present embodiment, the first coil 3*a* wound on one of the limbs of the first magnetic core 1 and the third coil 5*a* have a structure of double layers of windings, so that the magnetic fluxes $F_1$ and $F_3$ are offset with each other in this limb with respect to the line current "A". The coupling between the coils can thus be improved. As a result, the magnetic saturation characteristic of the magnetic core 1 is improved, and the inductance value can be set freely without regard to the number of turns or the setting of the magnetic circuit of the normal-mode choke coil section "N" by changing the sectional area of the magnetic core 1. Also, a material of high permeability can be selected instead of the conventional low-permeability material with a high saturation flux density, with the result that an inductance value about two or three times larger than in the prior art can be secured, thereby permitting a remarkable decrease in size. The improved coupling coefficient reduces the leakage fluxes.

In addition, with both the common- and normal-mode choke coil sections "C" and "N", the winding width of each coil can be accommodated in a single limb, and therefore a longer coil can be wound than in the prior art. In the case where a partitioned winding structure is employed, a multi-partitioned winding becomes possible, and therefore it is possible to provide a coil smaller in stray capacity than the prior art with an improved high-frequency characteristic.

In the above-mentioned embodiment, a choke coil is completed by connecting the first coil 3*a* and the second coil 4*a*. As an alternative method, the second coil 4*a* and the third coil 5*a* may be connected to equal effect. This applies to the embodiments described below.

The choke coil according to another embodiment shown in FIG. 3 has a configuration similar to the embodiment of FIG. 1 and will not be described again.

In the description of the second to seventh embodiments that follows, the same component parts as those of the first embodiment will be designated by the same reference numerals as those of the first embodiment respectively and will not be described again.

In the choke coil shown in FIG. 3, the same effect as the above-described case can, of course, be obtained by a configuration in which silicon steel sheets are used for the first magnetic core 1 and a ferrite material for the second magnetic core 2, a normal-mode choke coil section N is formed by the first coil 3*a* and the third coil 5*a*, and a common-mode choke coil section C is formed by the second coil 4*a* and the third coil 5*a*, with the first coil 3*a* connected to the second coil 4*a* or the first coil 3*a* to the third coil 5*a*.

(Embodiment 2)

Figure 4:
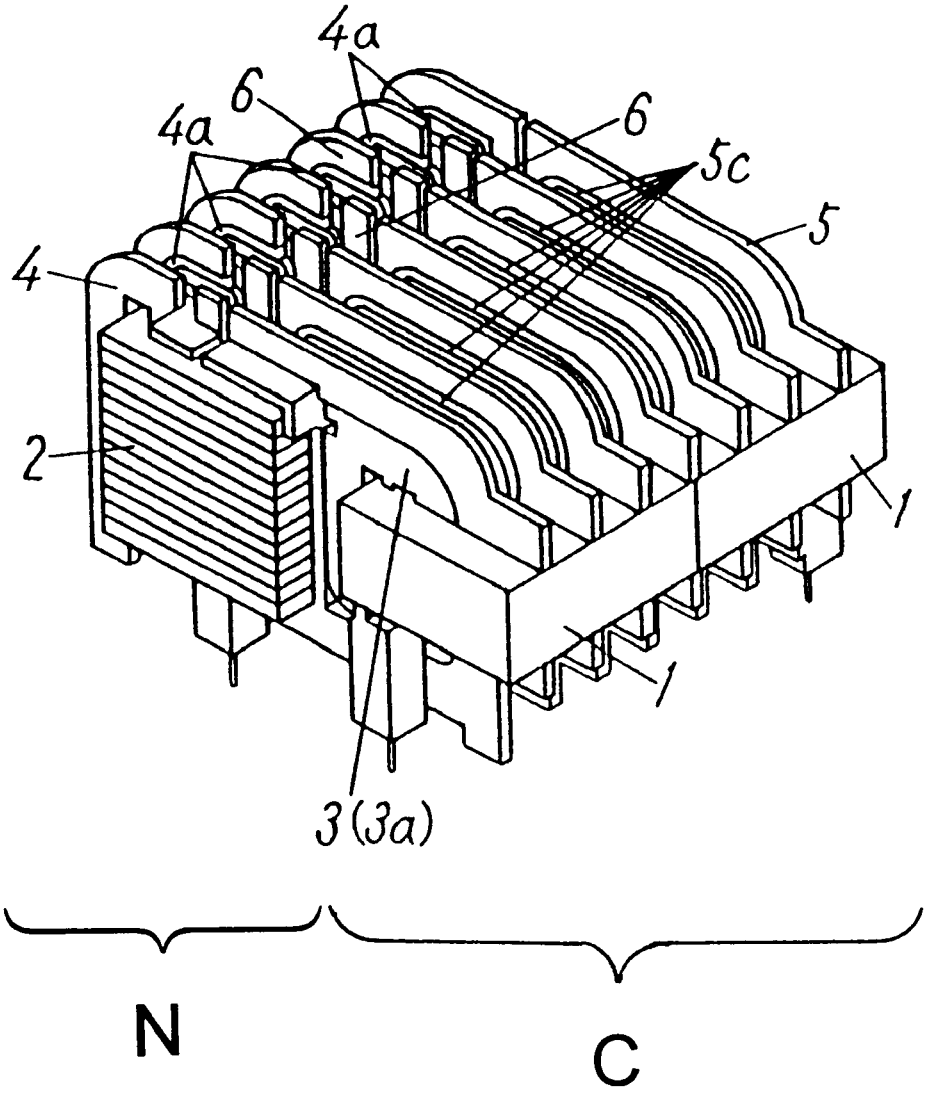
FIG. 4 is a perspective view showing a choke coil according to a further embodiment.
Figure 5:
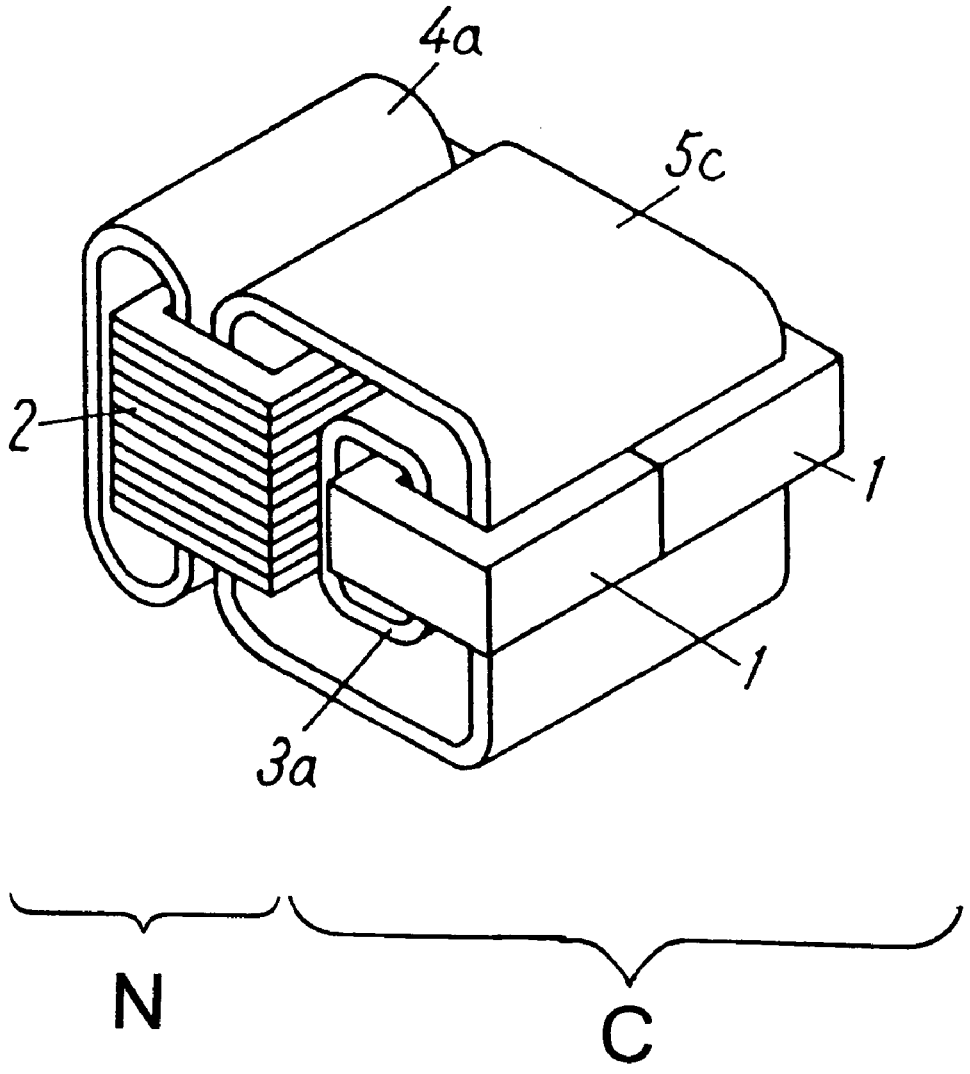
FIG. 5 is a model perspective view of the choke coil shown in FIG. 4.
Figure 6:
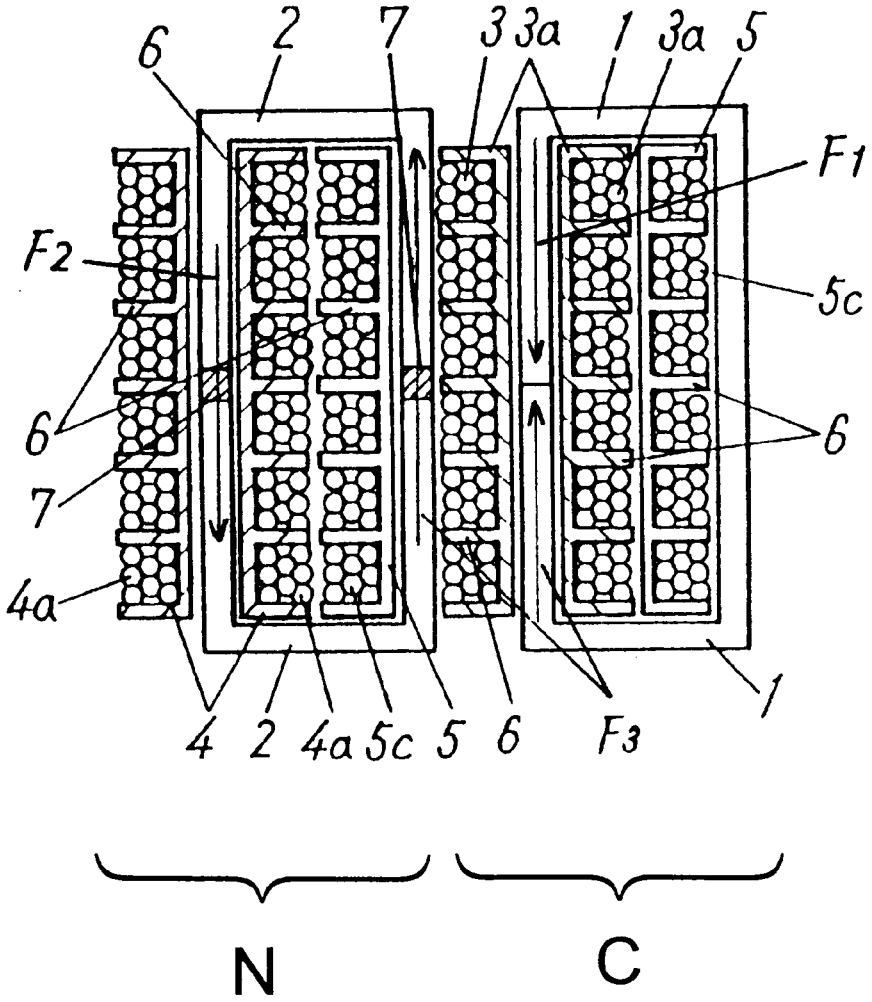
FIG. 6 is a sectional view of the same choke coil.

Further, FIGS. 4 to 7 show a perspective view, a model perspective view, a sectional view and a model perspective view of a development example, respectively, of a choke coil for preventing harmonic distortions according to a second embodiment of the invention. The same component parts as those in FIG. 1 are designated by the same reference numerals as in FIG. 1, wherein numerals 3, 4, 5 designate bobbins and numeral 6 partitioning flanges. In FIGS. 4–6, the normal-mode choke coil section and the common-mode choke coil section are designated by N and C, respectively, while the first, second and third magnetic fluxes are shown in FIG. 6 as F1, F2 and F3 respectively.

First, a first coil 3*a* is wound on one of the limbs of a first magnetic core 1 through a bobbin 3 partitioned by the partitioning flanges 6. One of the limbs of a second magnetic core 2 is wound with a second coil 4*a* through the bobbin 4 partitioned by the partitioning flanges 6. Further, a third coil 5*c* is wound in such a position as to cover the other limb of the second magnetic core 2 and the aforementioned one of the limbs of the first magnetic core 1 through the bobbin 5 partitioned by the partitioning flanges 6.

The first coil 3*a* wound on one of the limbs of the first magnetic core 1 and the third coil 5*c* wound on the first coil 3*a* are positioned in such a direction that the magnetic fluxes offset each other in the same limb with respect to the line current. The second coil 4*a* wound on one of the limbs of the second magnetic core 2 and the third coil 5*c* wound on the othe limb thereof, on the other hand, are wound in such a direction that the magnetic fluxes thereof do not offset each other in the closed-circuit magnetic core with respect to the line current. In this way, a circuit similar to the equivalent circuit of FIG. 34 is formed, while at the same time constituting the common-mode choke coil section "C" and the normal-mode choke coil section "N". The choke coil is completed by connecting the first coil 3*a* and the second coil 4*a*. Magnetic gaps 7 for improving the magnetic saturation characteristic in normal mode are uniformly formed on the butted surfaces of the two limbs of the second magnetic core 2. As shown in the figures and described throughout this specification, magnetic gaps 7 can be provided as noted above in various locations in the coil. Thus, the cores are not limited to closed-circuit magnetic cores, but can instead by open-circuit magnetic cores.

As described above, according to the present embodiment, an equivalent circuit of the invention can be configured of the same circuit as the conventional equivalent circuit shown in FIG. 34. Therefore, the same inductance value in normal mode required for a choke coil for preventing harmonic distortions can be secured as in the prior art, and also the function of a common-mode choke coil can be added. As a result, EMI can be prevented as well as harmonic distortions, and the common-mode choke coil so far used in the filter block of the power circuit can be eliminated for a saving of package space.

Furthermore, with the common-mode choke coil section "C", the first coil 3*a* wound on one of the limbs of the first magnetic core 1 and the third coil 5*c* are constructed in two layers. The magnetic fluxes are offset in this limb with respect to the line current, and therefore the coupling between coils can be improved. Consequently, the magnetic saturation characteristic of the magnetic core 1 is improved, and the inductance value can be freely set without regard to the number of turns or the setting of the magnetic circuit of the normal-mode choke coil section "N" by changing the sectional area of the magnetic core 1. Also, a high-permeability material may be used in place of the conventional material low in permeability and high in saturation flux density as the magnetic core 1, and therefore an inductance value about two or three times as high as the prior art can be secured, thereby contributing to a considerable size reduction.

With the normal-mode choke coil section "N", on the other hand, the two limbs of the second magnetic core 2 are enclosed in a complete core-type structure by the second coil 4*a* and the third coil 5*c* respectively wound on them. The magnetic gaps 7 provided for the purpose of improving the magnetic saturation in normal mode are also enclosed. Further, these magnetic gaps 7 are formed uniformly on the butted surfaces of the limbs, so that the magnetic fluxes in the magnetic core 2 can be made uniform and the leakage magnetic fluxes considerably reduced. The magnetic fluxes after reduction are about one fifth of the conventional structure without a shield case, and about one fourth of the conventional one with a shield case. As a result, the adverse effect on other parts, and in the case of television set, a fatal defect of picture fluctuations, can be prevented to a considerable degree.

The shield case 64 which has conventionally been used for preventing leakage fluxes is also eliminated, with the result that the insulating case 63 and the casting resin 65 can be done without. The cost is thus considerably reduced and the frequency characteristics improved. In the common- and normal-mode choke coil sections "C" and "N", the winding width of each coil can be accommodated in a single limb. The coil can thus be wound longer than in the prior art.

When a partitioned winding structure is employed, therefore, a multi-partitioned winding is made possible, and a coil smaller in stray capacity than in the prior art is provided with an improved frequency characteristic.

Figure 7:
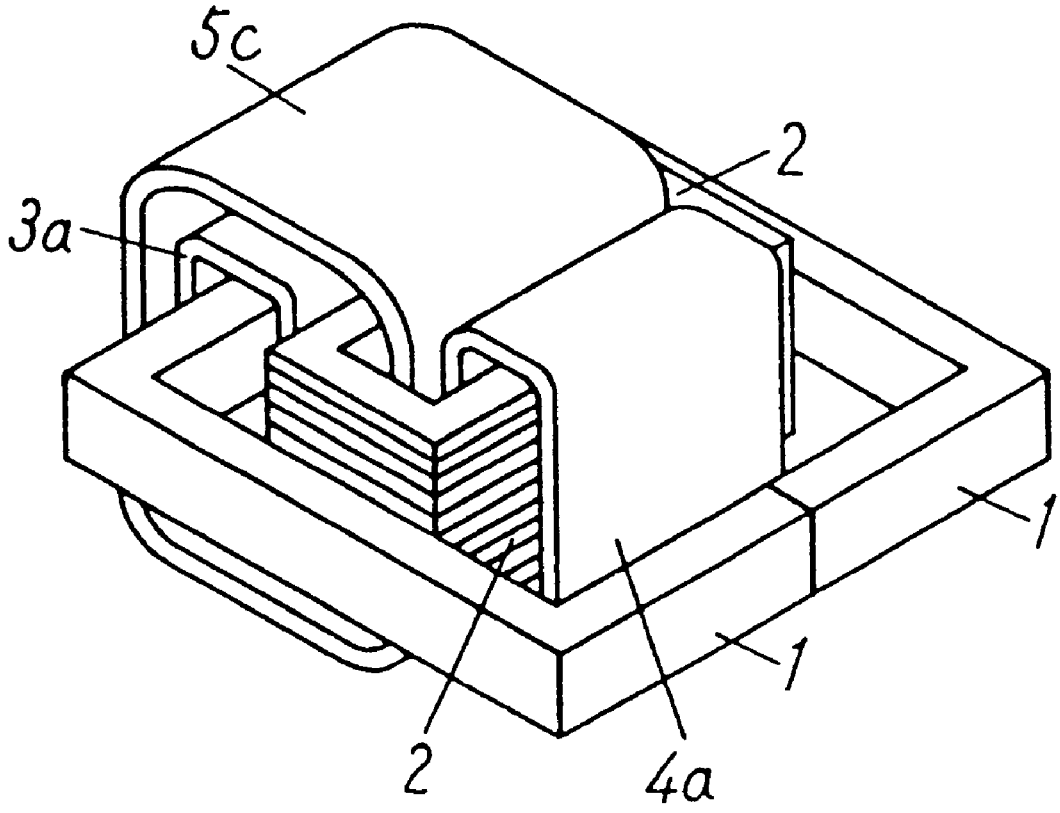
FIG. 7 is a model perspective view of the development example of the embodiment shown in FIG. 4, FIGS. 8(*a*) and 8(*b*) are a model perspective view and a diagram showing a magnetic circuit respectively of a choke coil according to another embodiment.

A model perspective view of a choke coil for preventing harmonic distortions according to an embodiment of the invention is also shown in FIG. 7. This embodiment has a magnetic circuit configured in the same way as and has the same effect as the second embodiment of the invention.

(Embodiment 3)

Figure 8:
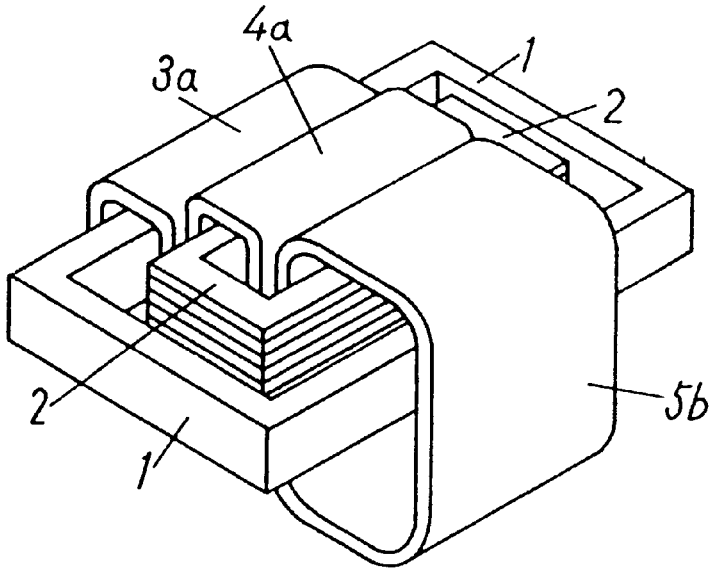
Figure 8:
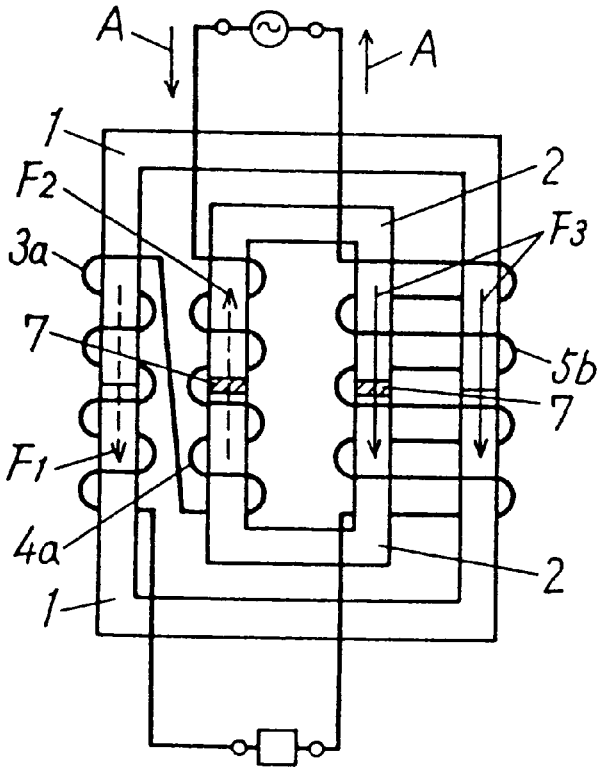

FIGS. 8(*a*) and 8(*b*) show choke coils for preventing harmonic distortions according to a third embodiment of the invention. The third embodiment will be described with reference to the same reference numerals attached as in the embodiment of FIG. 1. First, a first coil 3*a* is wound on one of the limbs of a first magnetic core 1, and a second coil 4*a* on one of the limbs of a second magnetic core 2. The second magnetic core 2 is positioned inside a magnetic circuit of the first magnetic core 1 on one of the limbs of which the first coil 3*a* is wound. Further, a third coil 5*b* is wound in such a position as to cover the other limb of the first magnetic core 1 and the other limb of the second magnetic core 2. The partitioned winding may be employed as a method of winding to improve the high frequency characteristic.

The first coil 3*a* wound on one of the limbs of the first magnetic core 1 and the third coil 5*b* wound on the other limb thereof are positioned in such a direction that the magnetic fluxes $F_1$ and $F_3$ offset each other in the closed-circuit magnetic core with respect to the line current "A". Also, the second coil 4*a* wound on one of the limbs of the second magnetic core 2 and the third coil 5*b* wound on the other limb thereof are positioned in such a direction that the magnetic fluxes $F_2$ and $F_3$ do not offset each other in this closed-circuit magnetic core with respect to the line current "A". In this way, a circuit similar to the equivalent circuit of FIG. 34 is formed, while at the same time making up a common-mode choke coil section "C" and a normal-mode choke coil section "N". The choke coil is then completed by connecting the first coil 3*a* and the second coil 4*a*. When it is desired to provide a magnetic gap in order to improve the magnetic saturation characteristic in normal mode, such magnetic gaps 7 are formed uniformly in the butted surfaces of the two limbs of the second magnetic core 2.

As described above, according to this embodiment, the equivalent circuit of the invention can be configured with the same circuit as the conventional equivalent circuit shown in FIG. 34. Therefore, the same normal-mode inductance value can be secured as in the prior art as required for a choke coil for preventing harmonic distortions. At the same time, the function of a common-mode choke coil can be added. As a consequence, EMI can be prevented as well as harmonic distortions, and the common-mode choke coil that has thus far been provided in the filter block of the power circuit can be eliminated for a saving of package space.

Furthermore, in the normal-mode choke coil section "N", the two limbs of the second magnetic core 2 are enclosed in a complete core-type structure of the second coil 4*a* and the third coil 5*b* wound thereon respectively, and so are the magnetic gaps 7 formed for improving the magnetic saturation in normal mode. In addition, the uniform provision of the magnetic gaps 7 on the butted surfaces of the limbs secures uniform magnetic fluxes within the magnetic core 2 and thereby considerably reduces the leakage fluxes. In particular, as the second magnetic core 2 is positioned inside the magnetic path of the first magnetic core 1 which makes up the common-mode choke coil section "C", the shield effect on the leakage fluxes is obtained.

Consequently, a shield case 64 which has so far been used to prevent leakage fluxes can be eliminated from the choke coil for preventing harmonic distortions. This makes it possible to eliminate the insulating case 63 and the casting resin 65 for a considerable cost reduction. This elimination has no adverse effect on the other parts and prevents picture fluctuations of the television set or the like.

Furthermore, with the common- and normal-mode choke coils "C" and "N", each limb can be accommodated by the winding width of a single coil, and therefore a longer coil can be wound than in the prior art. In the case where the partitioned winding structure is employed, therefore, a multi-partitioned winding is made possible, and as compared with the prior art, a coil with a small stray capacity can be provided for an improved high-frequency characteristic.

Also, according to an embodiment of the invention, characteristics required of normal and common modes can be selected by combining magnetic materials having different magnetic properties such as permalloy, iron dust, Sendust or amorphous, by combining at least three types of magnetic materials or by setting a desired geometry in order to achieve a high permeability, a high magnetic saturation power and a high frequency from the first magnetic core and the second magnetic core.

Figure 9:
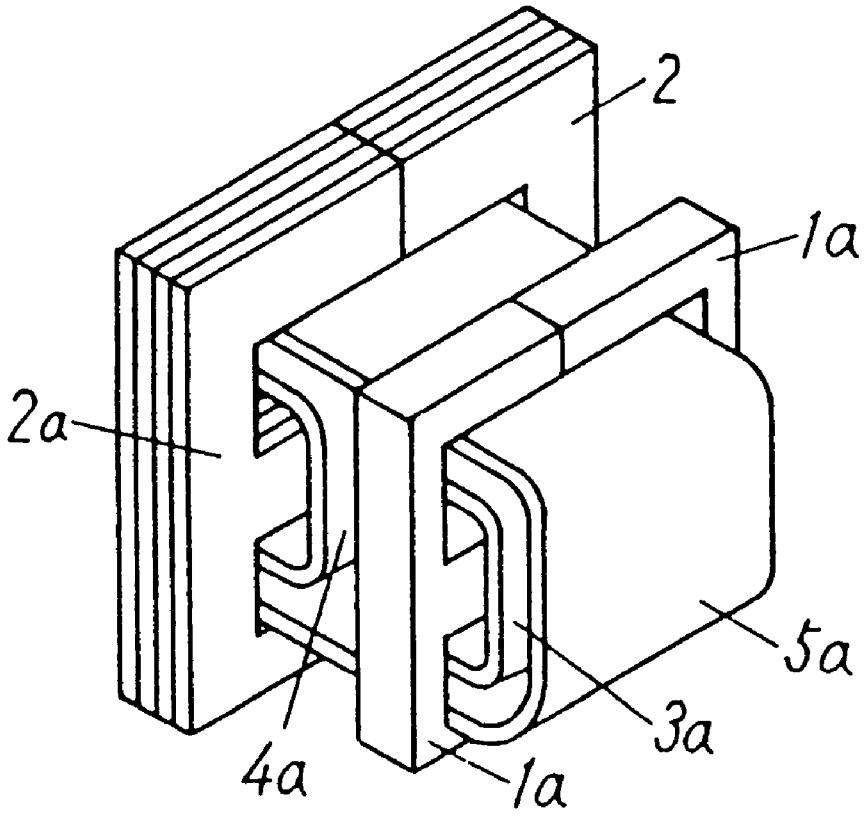
FIG. 9 is a model perspective view of a development example of the embodiment shown in FIG. 1.
Figure 10:
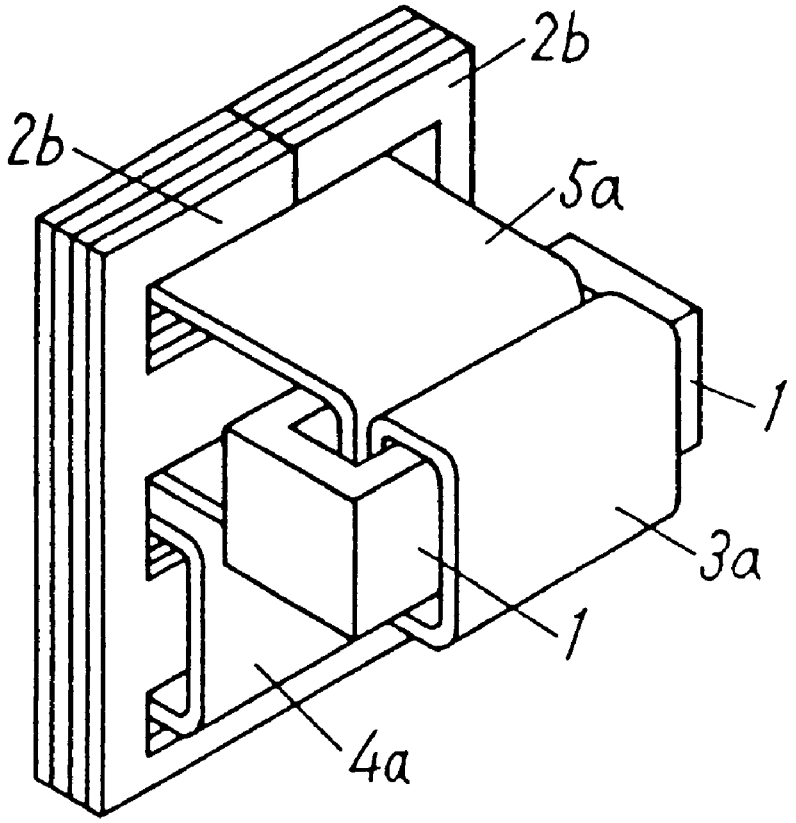
FIG. 10 is a model perspective view of a development example of the embodiment shown in FIG. 8.

In particular, although only the structure of a single-rectangle-shaped closed-circuit magnetic core is shown as the first and second magnetic cores, a double-hung rectangle or a triple-hung rectangle as shown in FIGS. 9 and 10 may be used for the closed-circuit magnetic cores to achieve a further improved effect.

The embodiments shown in FIGS. 9 and 10 will be described. These embodiments represent an application of the embodiments of FIGS. 1 and 8, respectively, in which corresponding parts are replaced by a double-hung rectangular closed magnetic circuit 1*a* of a ferrite material, a second magnetic core 2*a* having a double-hung rectangular closed magnetic circuit made of silicon-steel sheets and a second magnetic core 2*b* having a triple-hung rectangular closed magnetic circuit, respectively. In this configuration, the first magnetic core 1*a* has the magnetic fluxes thereof dispersed as compared with the structure having a single-rectangle-shaped closed magnetic circuit.

Further, as described with reference to the aforementioned embodiments, the first, second and third coils can of course be formed of a copper wire or a copper foil or other foil material as a winding with an equal effect.

(Embodiment 4)

A fourth embodiment of the invention is described below with reference to FIGS. 11 and 12. The perspective view and the model plan view of FIGS. 11 and 12 show a choke coil more specifically on the basis of the first embodiment shown in FIGS. 4 and 5.

Figure 11:
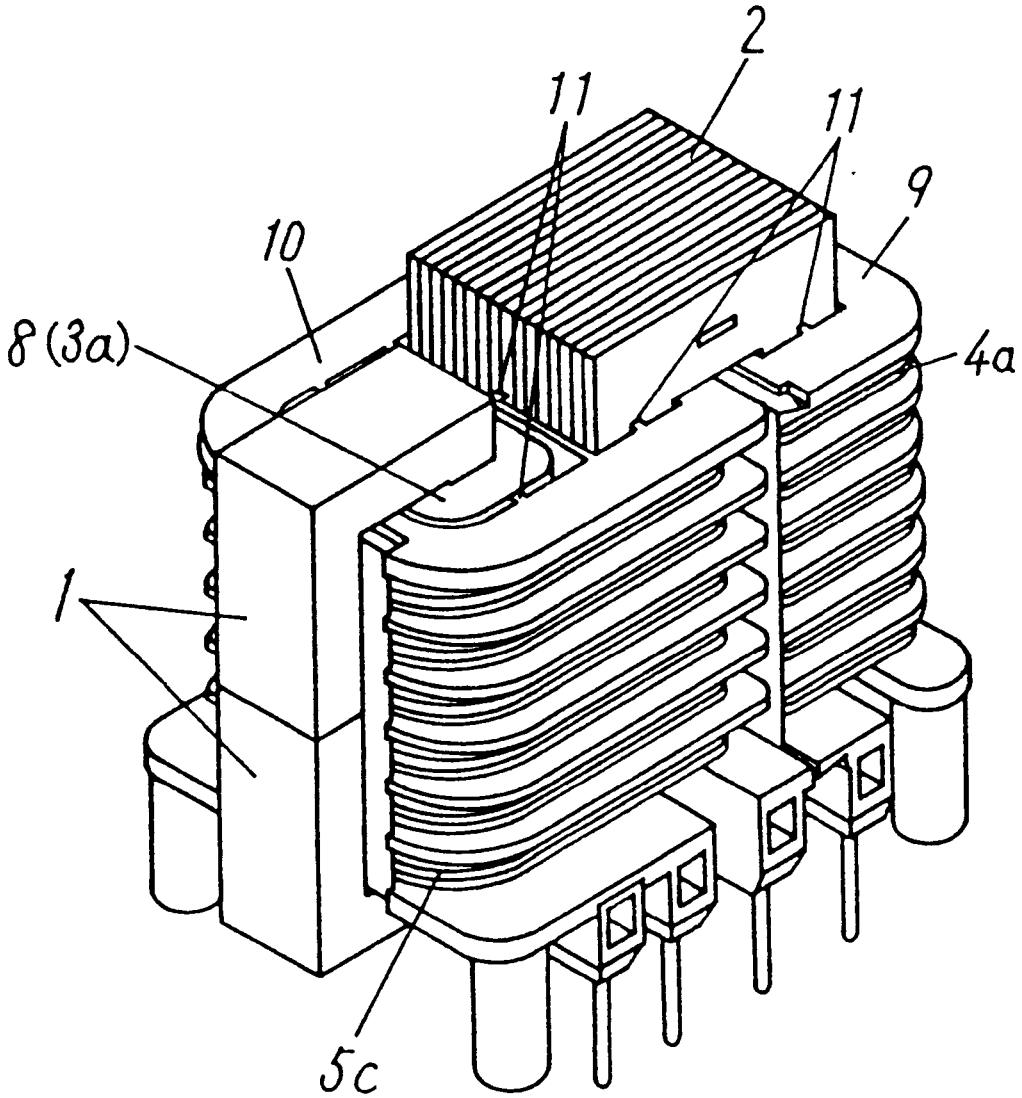
FIG. 11 is a perspective view of another embodiment of the invention.
Figure 12:
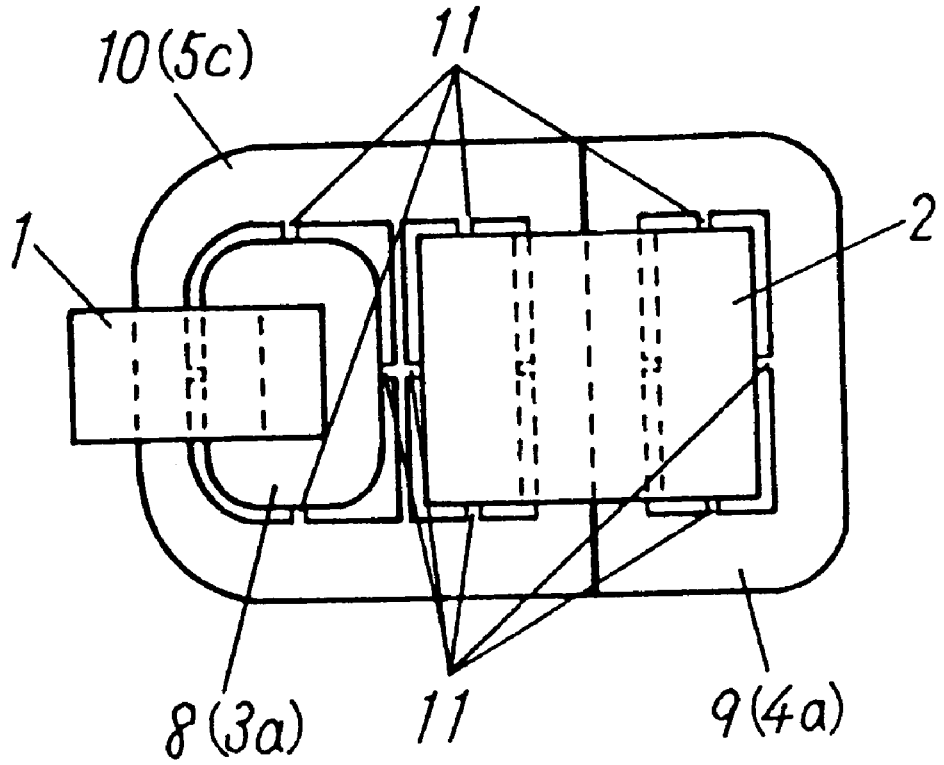
FIG. 12 is a model plan view of the same embodiment.

In FIGS. 11 and 12, a first bobbin 8 is mounted closely without any air gap on one of the limbs of the first magnetic core 1 made of a ferite material, and a first coil 3*a* is wound through the first bobbin 8. A second bobbin 9 is mounted with an air gap by a support member 11 on one of the limbs of the second magnetic core 2 made of silicon steel sheets. The second coil 4*a* is wound through the bobbin 9. The third bobbin 10 is formed with an air gap by the support member 11 in such a manner as to cover the outer side of the first bobbin 8 and the other limb of the magnetic core 2, and the third coil 5*c* is wound through the third bobbin 10.

The first coil 3*a* wound on one of the limbs of the first magnetic core 1 and the third magnetic coil 5*c* wound on the first coil 3*a* are positioned in such a direction as to offset the magnetic fluxes thereof each other by the same limb with respect to the line current, thereby configuring a common-mode choke coil section "C". Also, the second coil 4*a* wound on the one of the limbs of the second magnetic core 2 and the third coil 5*c* wound on the other limb are positioned in such a direction that the magnetic fluxes thereof do not offset each other in a closed-circuit magnetic core with respect to the line current, thereby configuring a normal-mode choke coil section "N".

More specifically, according to the embodiment described above, the first coil 3*a* is wound closely on the first magnetic core 1 through the first bobbin 8 without any air gap being formed.

A choke coil with the first coil 3*a* closely attached to the first magnetic core 1 without any air gap is compared with a reference of the same pair not closely attached to each other in Table 1 in terms of the result of temperature increase under the load of the stray capacity and the rated current.

TABLE 1

| | Stray capacity | Temperature increase |
|---|---|---|
| Choke coil of embodiment 1 | 16.5 pF | 48.3K |
| Reference | 20.7 pF | 54.3K |

Figure 13:
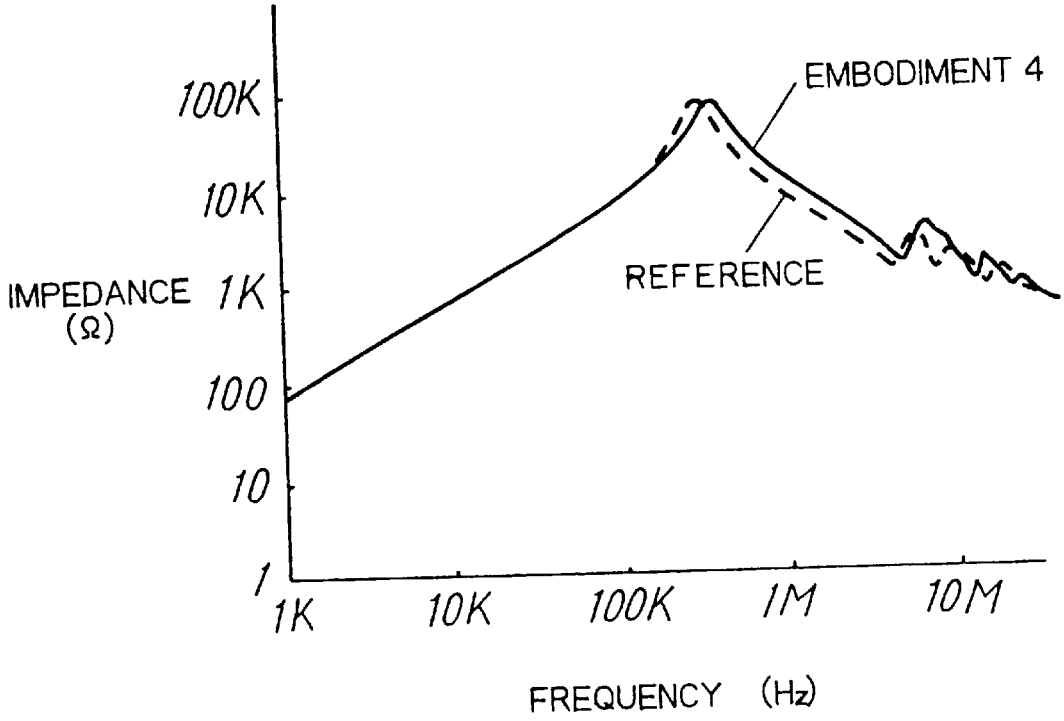
FIG. 13 is a diagram for comparing the frequency characteristics between the embodiment of FIG. 11 and a reference.

As is obvious from Table 1, the choke coil according to this embodiment has a superior advantage in reducing the stray capacity. In a common choke coil (not shown), a close arrangement of the coil and the magnetic core without any air gap increases the stray capacity between therebetween and deteriorates the frequency characteristic. The coil and the magnetic core, therefore, are generally detached as in the case of reference. Conversely, however, in the case of a choke coil of a two-core three-winding structure such as the one according to this embodiment, it has become apparent that the stray capacity can be reduced by closely attaching the coil and the magnetic core without any air gap being formed therebetween. As a consequence, the frequency characteristic of the impedance of the common-mode choke coil section "C" especially requiring a high-frequency characteristic can be effectively improved. The result of improvement is shown in FIG. 13.

Also, since the first bobbin 8 is attached closely to the first magnetic core 1 of a ferrite material without any air gap, the heat generated in the first coil 3*a* is efficiently transmitted from the bobbin to the magnetic core, thereby reducing the temperature increase.

As described above, according to this embodiment, the first coil 3*a* wound on one of the limbs of the first magnetic core 1 of a ferrite core material forming a common-mode choke coil section "C" is closely attached to the first bobbin 8 without any air gap being formed therebetween, and therefore the stray capacity can be reduced for an improved frequency characteristic while at the same time reducing the temperature increase.

(Embodiment 5)

Figure 14:
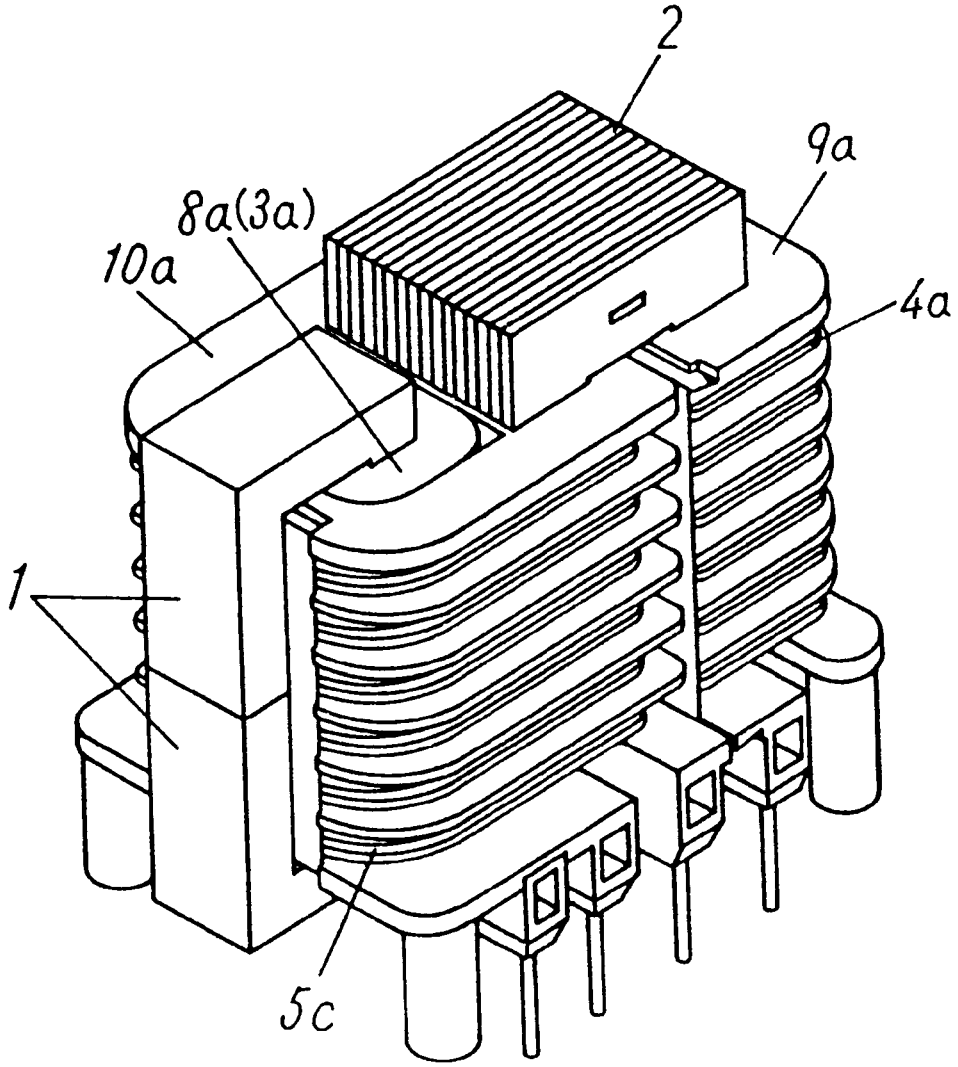
FIG. 14 is a perspective view of another embodiment of the invention.
Figure 15:
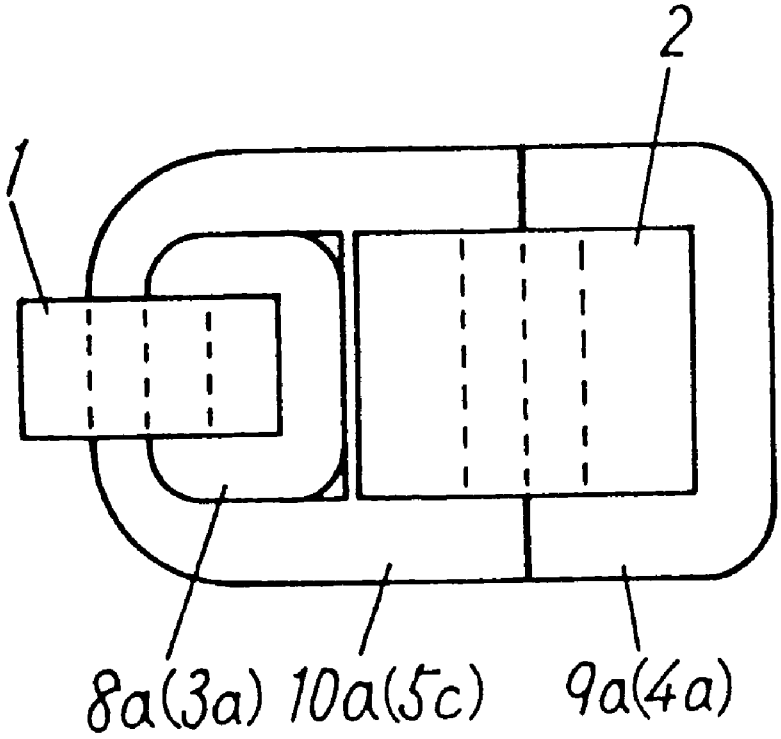
FIG. 15 is a model plan view of the same embodiment.

FIGS. 14 and 15 are a perspective view and a model plan view respectively of a choke coil according to a fifth embodiment of the invention. This embodiment basically represents an attempt to improve the embodiment shown in FIGS. 11 and 12. The configuration of this embodiment is different from that of the fourth embodiment in that a support member 11 in contact with the outside of the first bobbin 8 and the limbs of the second magnetic core 2 of silicon steel sheets are eliminated so that the first coil 3*a* is closely attached to the magnetic core without any air gap therebetween.

More specifically, according to this embodiment, the first coil 3*a* is closely attached to the first magnetic core 1 through the first bobbin 8*a* without any air gap therebetween, the second coil 4*a* is also closely attached to the second magnetic core 2 through the second bobbin 9*a* without any air gap, and the third coil 5*c* is closely attached to the second magnetic core 2 through the third bobbin 10*a* without any air gap therebetween.

The result of temperature increase of the choke coil according to the embodiment is compared with a reference in Table 2 below under the load of the stray capacity and the rated current.

TABLE 2

| | Stray capacity | Temperature increase |
|---|---|---|
| Embodiment 2 | 14.3 pF | 49.7K |
| Prior art | 20.7 pF | 54.3K |

Figure 16:
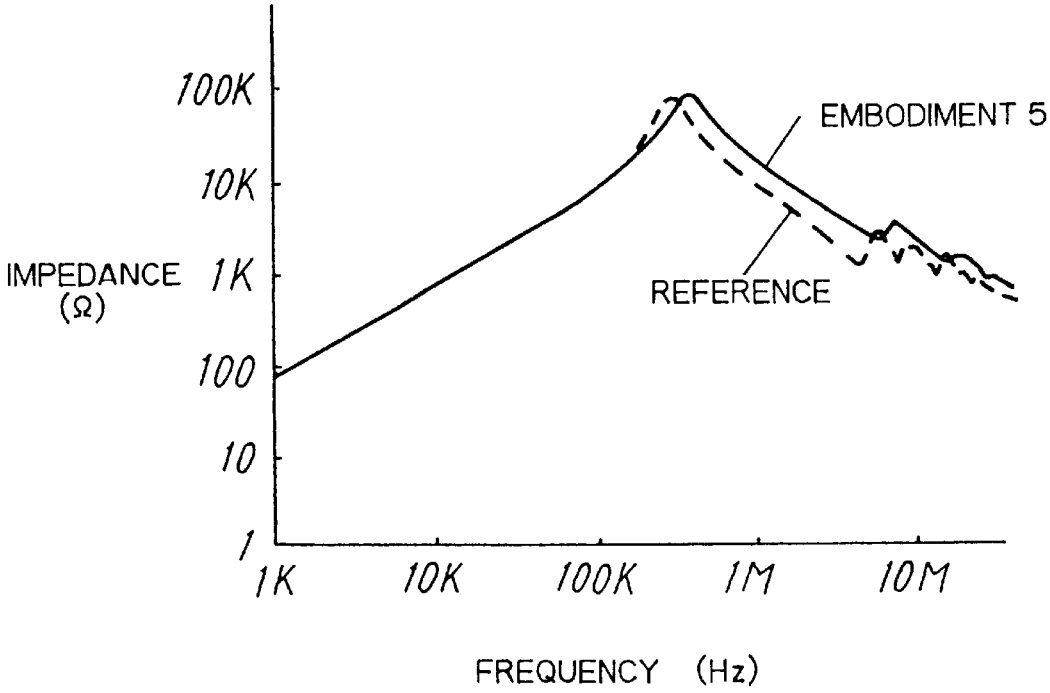
FIG. 16 is a diagram for comparing the frequency characteristics between the embodiment of FIG. 14 and a reference.

As obvious from Table 2, the choke coil according to this embodiment has a superior advantage in stray capacity. As a result, the frequency characteristic of impedance of the common-mode choke coil section "C" is also improved, as the result thereof is shown in FIG. 16.

Also, the temperature increase is reduced as compared with the reference in view of the fact that the first bobbin 8*a* is closely attached to the first magnetic core 1, and the second bobbin 9*a* and the third bobbin 10*a* to the second magnetic core 2 without forming any air gap, thereby allowing heat to be transmitted from the bobbin to the magnetic core. Further, the choke coil is reduced in size by the size of the support member 11 removed, and the amount of copper wires can be reduced by about 10% for a reduced cost.

As explained above, according to this embodiment, the second coil 4*a* and the third coil 5*c* wound on the limbs of the second magnetic core 2 of silicon steel sheets as well as the first magnetic core 1 of a ferrite material making up the common-mode choke coil section "C" of the fourth embodiment are closely attached to the first magnetic core 1 or the second magnetic core 2 without any air gap being formed therebetween. The stray capacity is thus reduced for an improved frequency characteristic, thereby reducing the temperature increase, the size and the cost.

Figure 17:
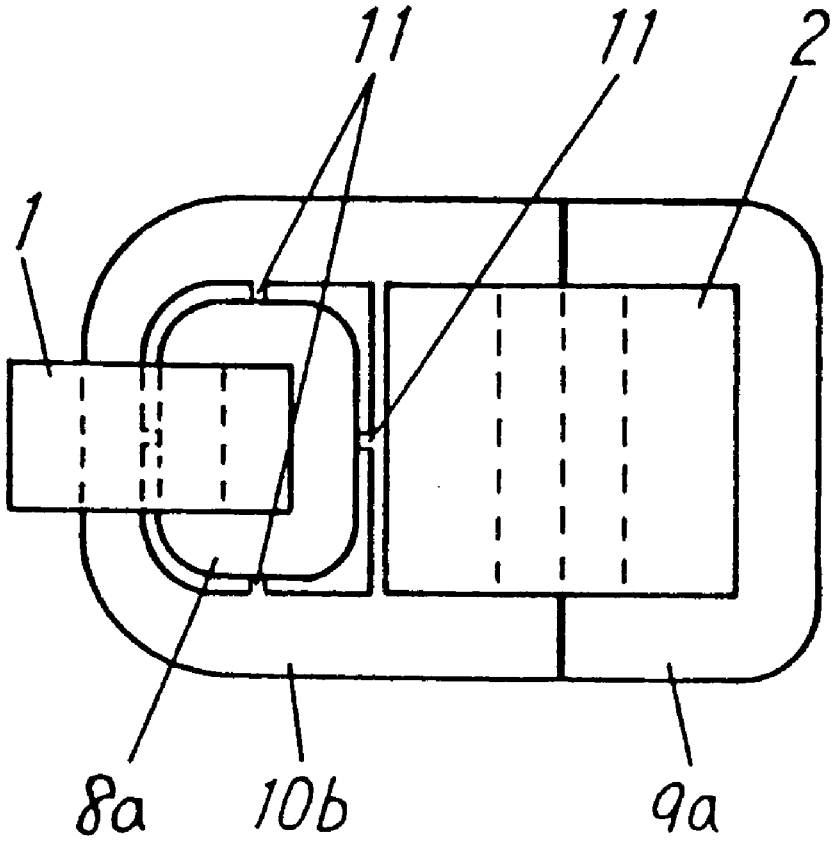
FIG. 17 is a model plan view of a development example according to the embodiment shown in FIG. 14.

The temperature increase can be further reduced by mounting a support member 11 on the third bobbin 10*b* in contact with the outside of the first bobbin 8*a* and thus allowing heat to be dissipated into the atmosphere, as shown in FIG. 17.

(Embodiment 6)

Figure 18:
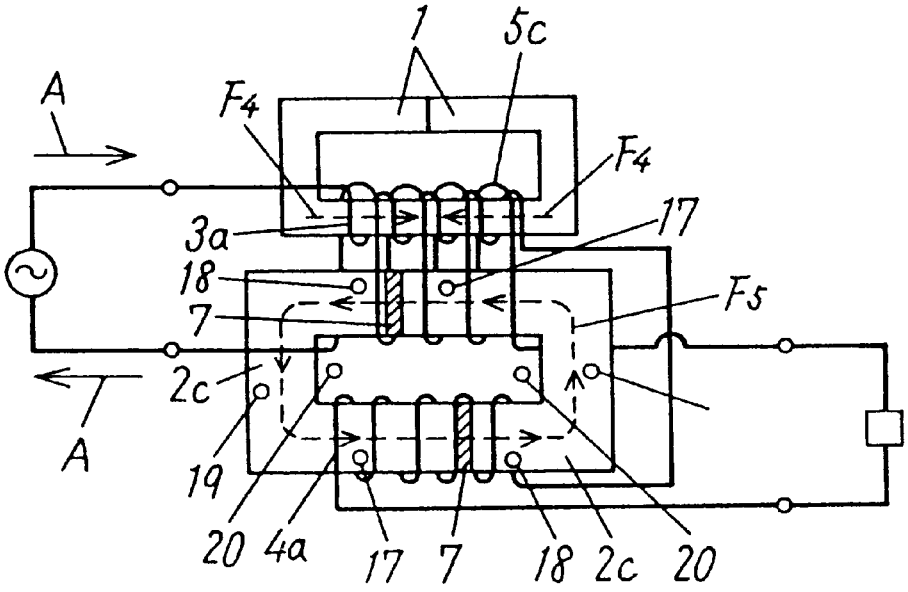
FIG. 18 is a diagram showing a magnetic circuit of another embodiment.
Figure 19:
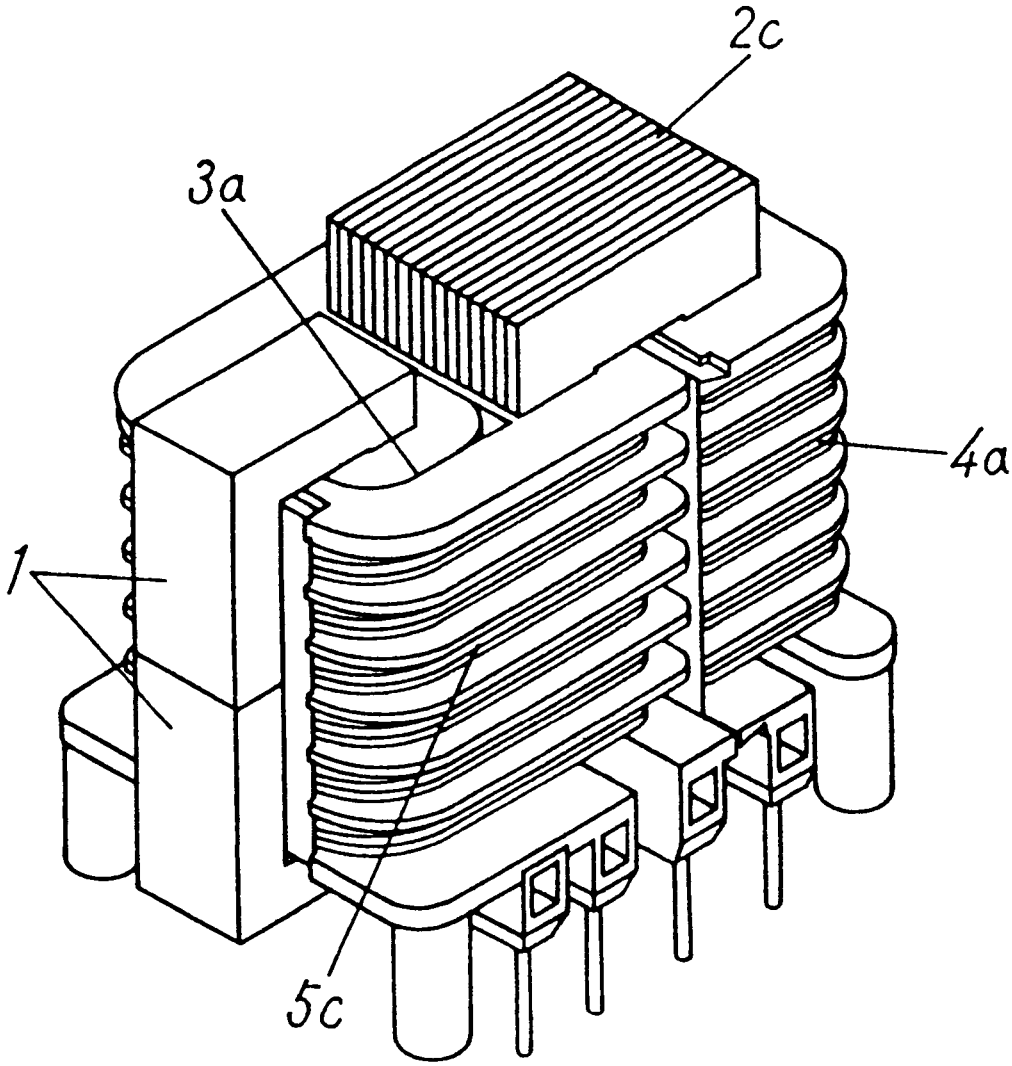
FIG. 19 is a perspective view of the same embodiment.
Figure 20:
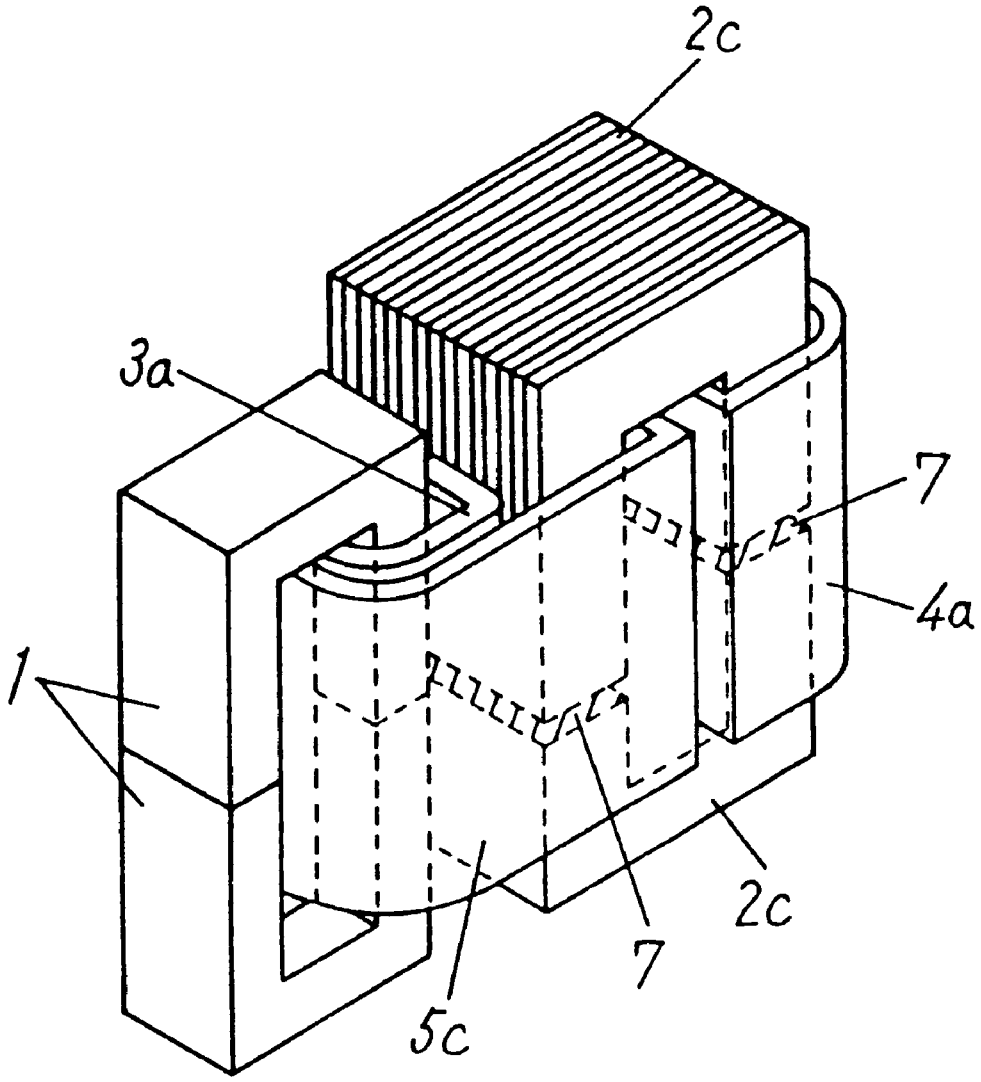
FIG. 20 is a model perspective view of the same embodiment.

FIGS. 18 to 20 show other embodiments of the invention which are basically intended to improve the performance of the embodiments shown in FIGS. 4 and 5.

In FIGS. 18 to 20, a first coil 3*a* is wound on one of the limbs of a first magnetic core 1 of a U-shaped ferrite, and a second magnetic coil 4*a* is wound on one of the limbs of a second magnetic core 2*c* of U-shaped laminated iron cores. Further, a third coil 5*c* is wound in such a manner as to cover the other limb of the second magnetic core 2*c* and one of the limbs of the first magnetic core 1.

The fist coil 3*a* wound on one of the limbs of the first magnetic core 1 and the third coil 5*c* wound on the first coil 3*a* are positioned in such a direction that the magnetic fluxes $F_4$ are offset in the same limb with respect to the line current "A", thereby constructing a common-mode choke coil section "C". Also, the second coil 4*a* wound on one of the limbs of the second magnetic core 2*c* and the third coil 5*c* wound on the other limb are arranged in such a position that the magnetic fluxes $F_5$ are generated in one direction with respect to the line current "A", thereby configuring a normal-mode choke coil section "N" for preventing harmonic distortions. A choke coil is completed by connecting the first coil 3*a* and the second coil 4*a*.

Figure 21:
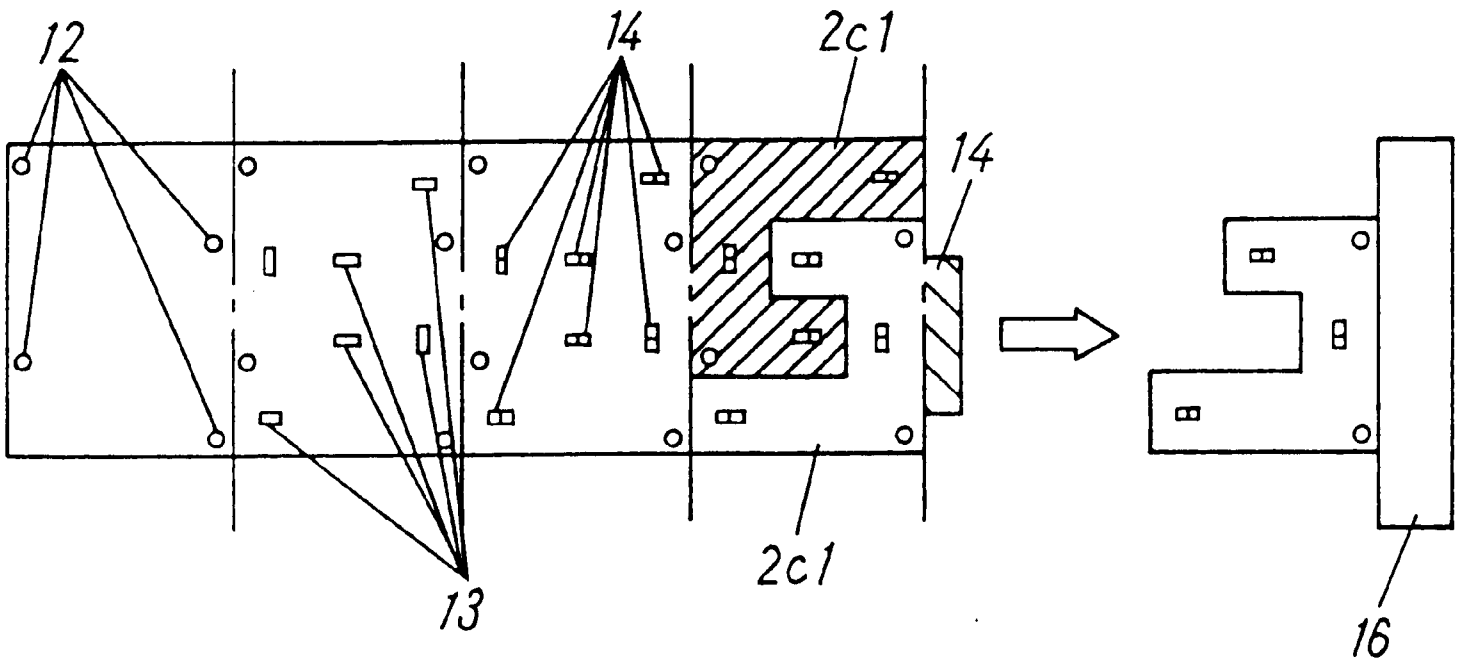
FIG. 21 is a diagram showing a punching layout of the U-shaped laminated iron cores.

FIG. 21 shows a punching layout of U-shaped laminated iron cores making up the second magnetic core 2*c* shown in FIGS. 18 to 20. The iron core band plate is punched out in such a layout that the difference in length between the limbs 17, 18 of the U-shaped iron core 2*cl* is at least equal to the width of the yoke 19, the width of the window 20 at least equal to the width of the limbs 17, 18, the shorter limb 18 of one of two sheets as a set is combined with the window 20 of the other sheet, and all the limbs 17, 18 are parallel with respect to the direction of pressure-rolling the iron core band plate. First, pilot holes 12 are formed, followed by forming caulking separation holes 13. This operation is performed on one of, say, ten laminations. Further, the U-shaped laminated iron cores not formed with the caulking separation holes 13 are formed with caulking protrusions 14. The U-shaped iron core portion 2*cl* shown by hatching is thus finally punched down, and simultaneously with the lamination, the protrustions and the reverse-side recesses of the upper and lower caulking protrusions 14 laid one on the other are fitted into each other, thereby integrating core sheets in the required number of, say, 10. The other separated U-shaped iron core portion 2*cl* not shown by hatching is moved to a stopper 16 to the right by a mechanical chuck or a permanent magnet 15 and then integrated by a predetermined number of sheets.

Instead of adding the process of forming the caulking separation holes 13 as described above, the punch may be driven so deep as to punch through and form the caulking separation holes 13 without forming the caulked protrusions 14 for each predetermined number of sheets. Further, the caulked protrusions 14 may be fitted with each other for each predetermined number of sheets without forming the caulking separation holes 13.

Especially, the number, position and the orientation of the pilot holes 12 and the caulked protrusions shown above are only an example and can be determined most appropriately from the viewpoint of productivity and characteristics.

The aforementioned laminated iron cores are shaped into U-shapes, with one of the limbs of each iron cores made shorter than the other limb thereof. Two sheets of iron cores can thus be combined as a pair at the time of punching, thereby saving the punching loss.

Further, the iron core band plate is punched out in such a layout that all the limbs 17, 18 are parallel with respect to the direction of pressure-rolling the iron core band plate, and therefore, lamination can be made on an automatic machine after punching out, therefore leading to a very high production efficiency. Also, with regard to the choke properties, as the direction of magnetic fluxes and the direction of pressure-rolling are the same in the limbs 17, 18, there is the advantage of obtaining a large inductance.

Since the balance between the lengths of the limbs 17 and 18 is lost, however, it was feared that a great amount of leakage fluxes may be generated due to the fact that the magnetic gaps where the fringing leakage fluxes are generated are displaced from the center of the coil winding and the leakage fluxes originating from the two limbs fail to offset each other in a balanced way at the crossing point thereof. According to this embodiment, however, the leakage fluxes can be considerably reduced by winding the coil on the two limbs of the second magnetic core 2*c* made of laminated iron cores. As a result, the use of the choke coil with TV or the like does not cause any fatal defect of picture fluctuations, and it could be confirmed that it is not necessary to take the expensive measure for magnetic shield.

It is thus possible to provide an inexpensive magnetic core made of laminated iron cores making up the essential parts with reduced leakage fluxes.

Figure 22:
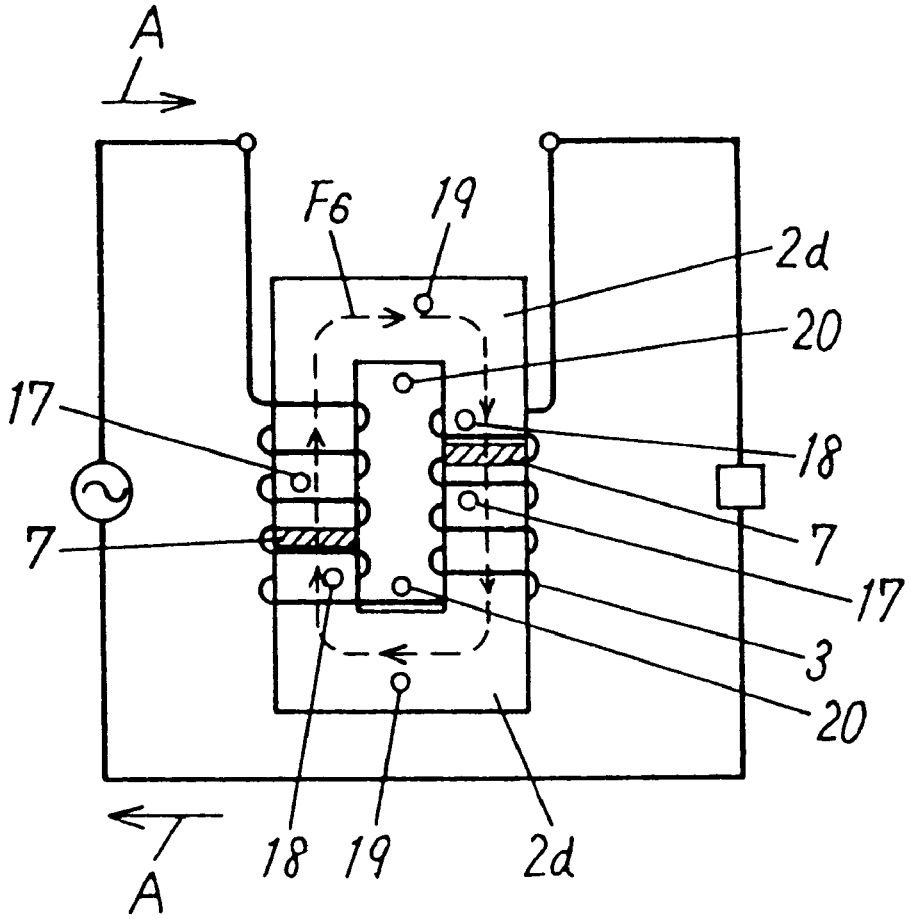
FIG. 22 is a diagram showing a magnetic circuit of a choke coil according to another embodiment.
Figure 23:
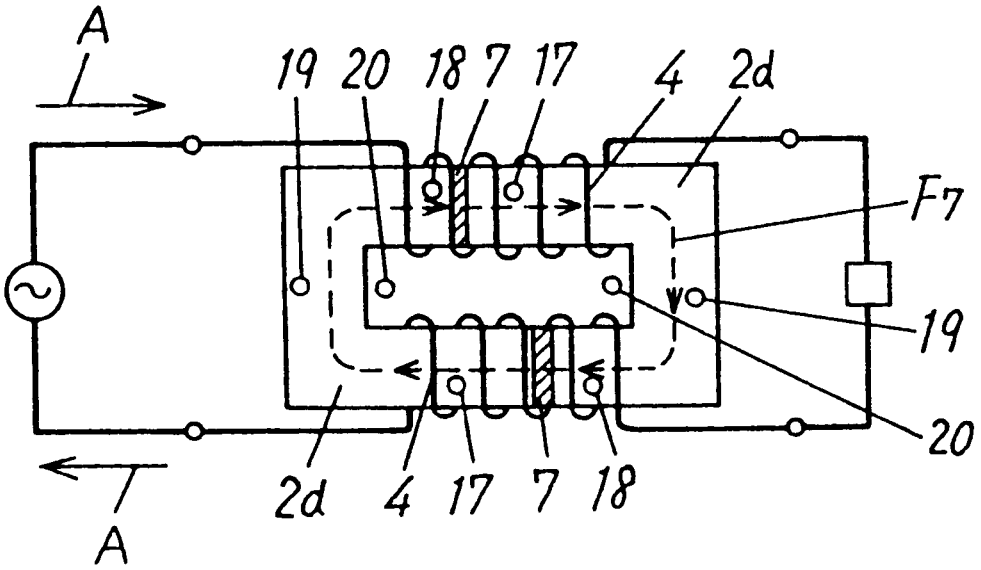
FIG. 23 is a diagram showing a magnetic circuit of a choke coil according to another embodiment, FIGS. 24(*a*), 24(*b*) and 24(*c*) are diagrams showing a magnetic circuit, an enlarged view of a limb of the essential parts and a sectional view taken in line X-X' in FIG. 25(*b*) respectively according to another embodiment.

Although the foregoing description of the embodiment has dealt with a choke coil in which the third coil 5*c* is wound in such a position as to cover the first and second magnetic cores 1 and 2*c*, other methods can be used as far as the choke coil uses laminated iron cores. FIGS. 22 and 23 show embodiments of the choke coil having such a structure. The shape of the laminated iron cores according to this embodiment is also described in detail with reference to FIGS. 22 and 23.

In FIG. 22, the difference between a limb 17 and a limb 18 of a magnetic core 2*d* made of U-shaped laminated iron cores is made equal to the width of a yoke 19, and the width of a window 20 is made equal to that of the limbs 17, 18. The ends of the two limbs 17, 18 of the iron cores are butted to each other with magnetic gaps 7 formed therebetween, so that a closed magnetic circuit is formed making up a magnetic core including single-phase double-limb laminated iron cores. A coil 3 is wound continuously on the two limbs of the magnetcic core 2*d* in such a manner that magnetic fluxes $F_6$ are generated in a direction with respect to a line current "A", thereby completing a choke coil. The limbs 17, 18 and the magnetic gaps 7 are wound with the coil 3 thereby to reduce leakage fluxes.

In FIG. 23, a coil 4 is wound on each of the two limbs of a magnetic core 2*d* made of the same laminated iron cores as that in FIG. 1 in such a manner that magnetic fluxes $F_7$ are generated in a direction with respect to the line current "A", thereby completing a choke coil.

Also, according to the above-mentioned embodiments, as compared with the choke coil shown in FIG. 22, the choke coil shown in FIGS. 18 and 23 has such a coil winding structure that the choke coil can be inserted in the two sides of an AC input line, whereby noises can be attenuated (EMI prevented) in a frequency range of several hundred kHz. This is by reason of the fact that the choke coil shown in FIG. 22 which has such a coil winding structure that the choke coil can be inserted in only one side of the AC line and therefore noises are passed from the other line.

Table 3 shows the noise attenuation for 150, 500 and 700 kHz of the choke coils shown in FIGS. 22 and 23 according to the above-mentioned embodiments.

TABLE 3

| | 150 kHz | 500 kHz | 700 kHz |
|---|---|---|---|
| Choke coil described in FIG. 22 | −58 dB | −30 dB | −30 dB |
| Choke coil described in FIG. 23 | −62 dB | −32 dB | −31 dB |

It is found that the noise attenuation of the choke coil shown in FIG. 23 is greater by 1 to 4 dB than that shown in FIG. 22.

(Embodiment 7)

Another embodiment of the invention will be explained below with reference to FIGS. 24(*a*) to 26. This embodiment is aimed at an improved performance of the embodiment shown in FIG. 5.

Figure 24:
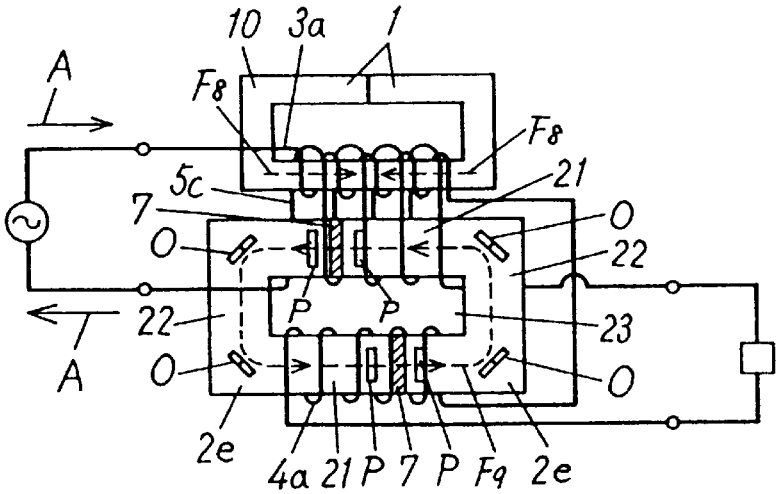
Figure 24:
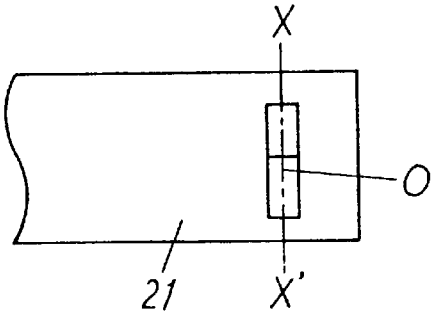
Figure 24:
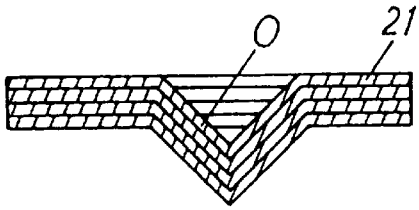
Figure 25:
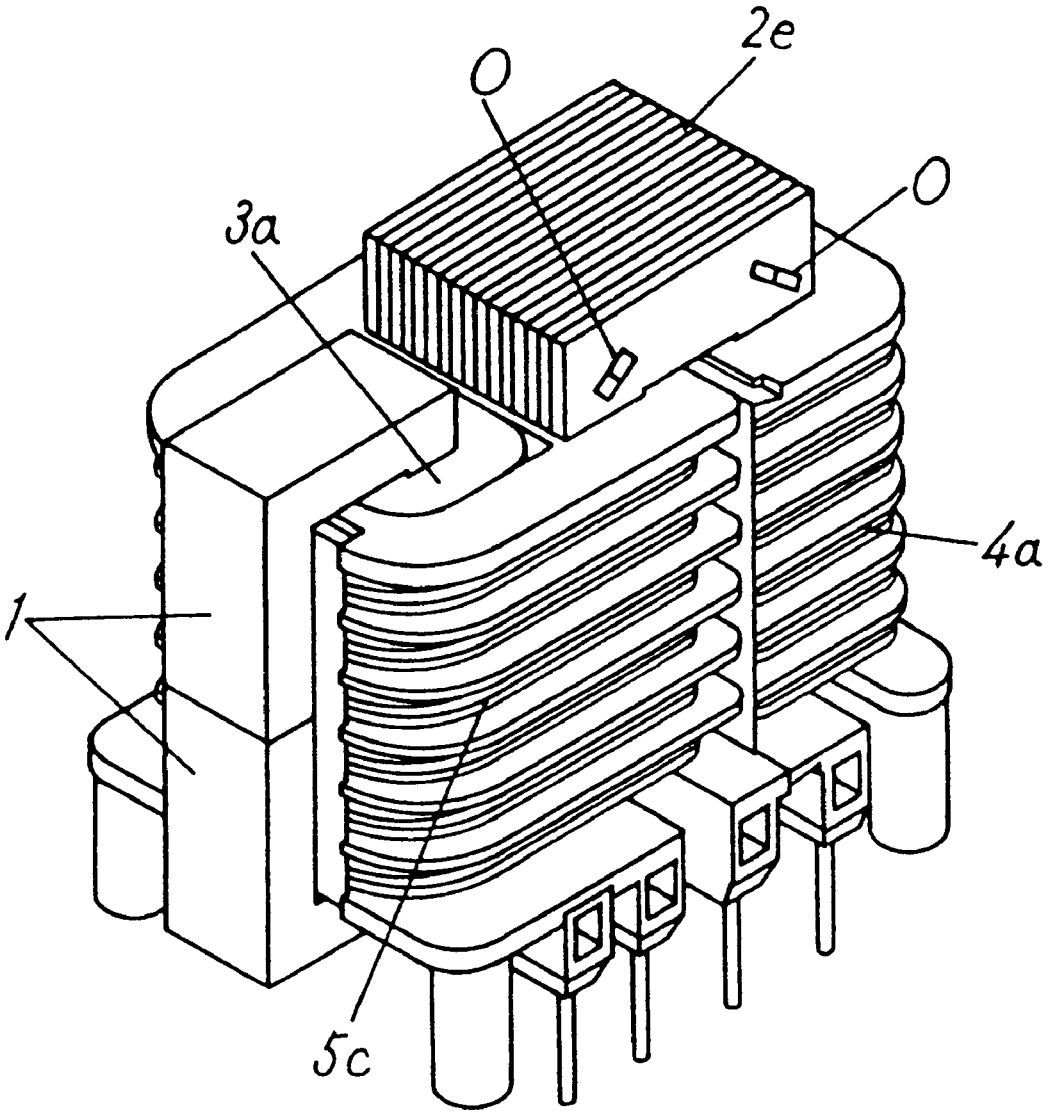
FIG. 25 is a perspective view of the same embodiment.
Figure 26:
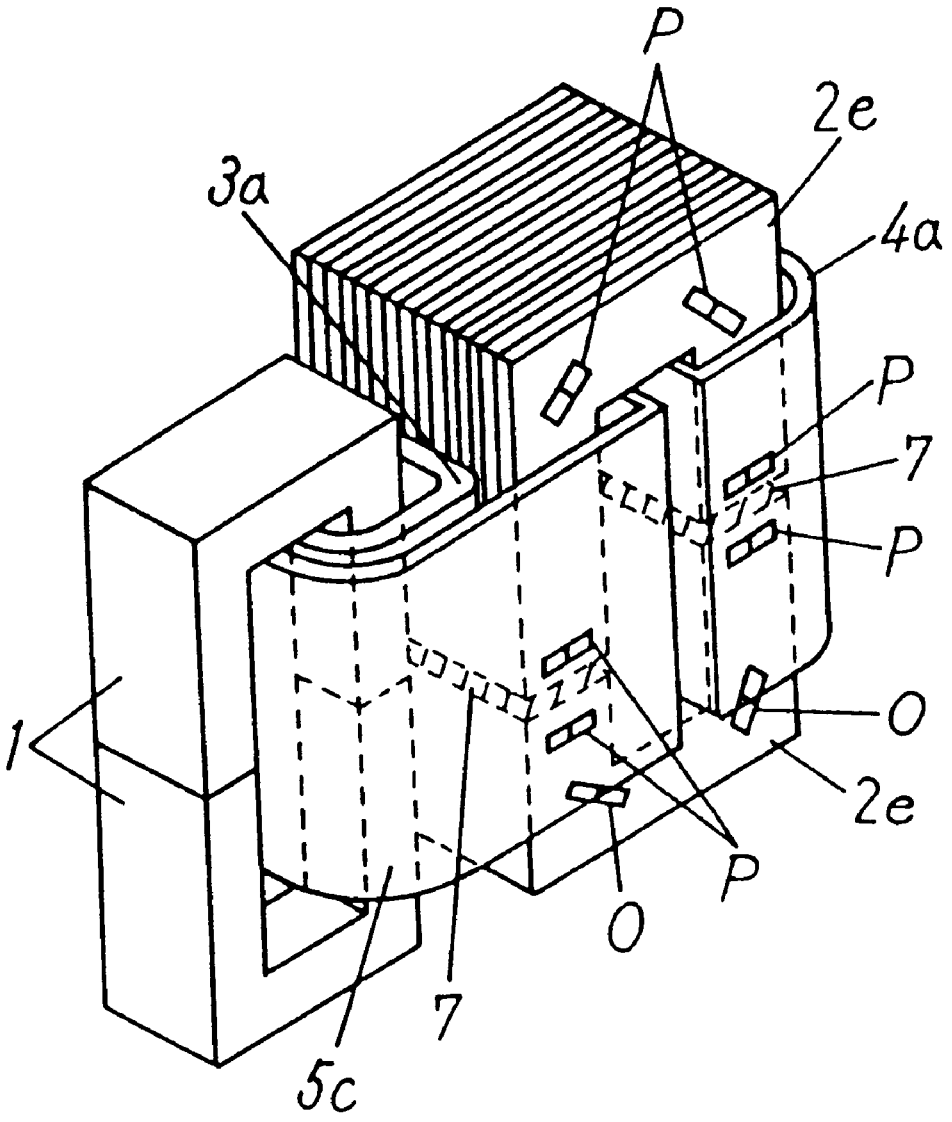
FIG. 26 is a model perspective view of the same embodiment.

In FIGS. 24(*a*) to 26, numeral 2*e* designates a second magnetic core made of U-shaped laminated iron cores, characters $F_8$, $F_9$ magnetic fluxes, and characters "O", "P" embossments for fixing the laminated iron cores. First, a first coil 3*a* is wound on one of the limbs of the first magnetic core 1 of a U-shaped ferrite. A second coil 4*a* is wound on one of the limbs of the second magnetic core 2*e* made of U-shaped laminated iron cores fixed by the embossments "O", "P". Further, a third coil 5*c* is wound in such a position as to cover the other limb of the second magnetic core 2*e* and one of the limbs of the first magnetic core 1. The first coil 3*a* wound on one of the limbs of the first magnetic core 1 and the third coil 5*c* wound on the first coil 3*a* are positioned in a such a direction that the magnetic fluxes $F_8$ are offset in the particular limb with respect to a line current "A", thereby making up a common-mode choke coil section "C". Also, the second coil 4*a* wound on one of the limbs of the second magnetic core 2*e* and the third coil 5*c* wound on the other limb are positioned in such a manner that the magnetic fluxes $F_9$ are generated in a direction with respect to the line current "A", thereby configuring a normal-mode choke coil section N for preventing harmonic distortions. The first coil 3*a* and the second coil 4*a* are connected to complete a choke coil.

The second magnetic core 2*e* is such that the difference in length between the two limbs 21 thereof is equal to the width of a yoke 22, and therefore, at the time of punching an iron core, two iron cores sheets can be combined as a pair, thereby saving the punching loss.

The second iron core 2*e* is laminated and fixed by means of V-shaped embossments "O", "P", for example, formed on the front and back of a multiplicity of iron core sheets punched out in a predetermined shape. The embossments "O", "P" are provided one each on each side of the yoke 22 and the limb 21 wound with the coil. Further, the embossments "P" formed on the limb 21 wound with the coil has the longitudinal side of the profile thereof oriented in the direction orthogonal to the flowing magnetic fluxes $F_9$, while the embossments "O" on the two sides of each yoke 22 is formed inclined inward toward each other as viewed from the window 23.

According to the above-mentioned embodiment, explanation was made about a choke coil for preventing harmonic distortions having the function of an anti-EMI common-mode choke coil. The above-mentioned embossments, however, can be applied also to normal choke coils as well.

Explanation will be made below with reference to FIG. 27.

Figure 27:
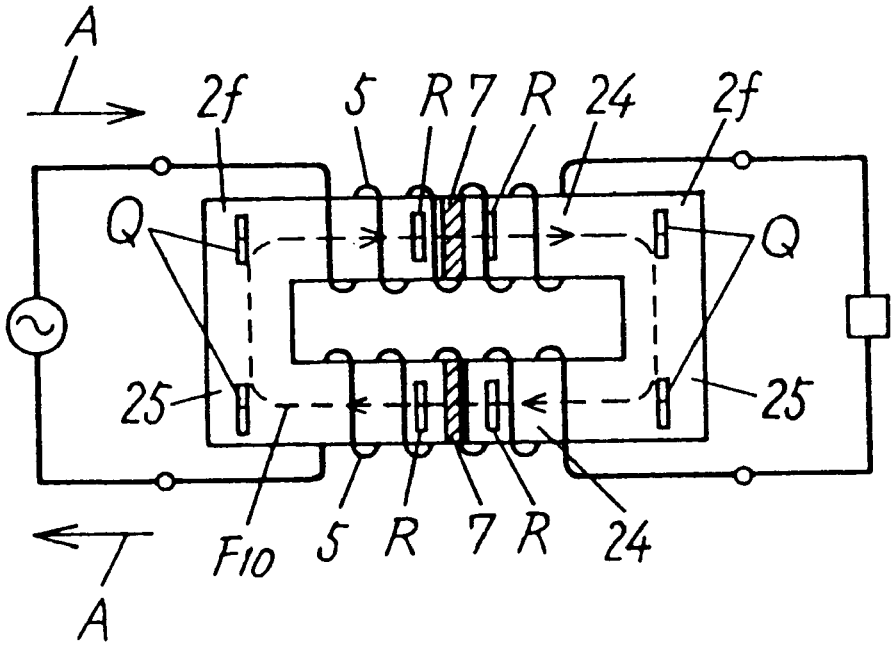
FIG. 27 is a diagram showing a magnetic circuit as a development example of the embodiment shown in FIG. 24(*a*), FIGS. 28(*a*) and 28(*b*) are a model diagram and a beat characteristic diagram respectively of the laminated iron cores having embossments, FIGS. 29(*a*) and 29(*b*) are a model diagram of laminated iron cores having embossments and a characteristic diagram showing the relation between the inductance, the laminated iron cores and leakage fluxes, respectively.

In FIG. 27, U-shaped laminated iron cores are fixed by embossments "Q", "R", and a magnetic gap 7 for improving the magnetic saturation characteristics is formed on each of the butted surfaces between the two limbs 24 of each iron core. In this way, a closed-circuit magnetic core 2*f* made of laminated iron cores is formed, and a coil 5 is wound on each of the two limbs of the magnetic core thereby to complete a choke coil.

The magnetic core 2*f* made of laminated iron cores is laminated and fixed by V-shaped embossments "M", "N", for example, formed on the front and back sides respectively of a multiplicity of iron core sheets punched out into a predetermined shape. The embossments "Q", "R" are provided one each on the two sides of the yoke 25 and the limb 24 wound with a coil. Further, the embossment "N" formed on the limb 24 wound with the coil 5 has the longitudinal sides of the profile thereof oriented orthogonal to the direction of the flowing magnetic fluxes $F_{10}$.

In FIGS. 24 and 27, the embossments "O", "P", "Q", "R" are formed one each on the two sides of the yokes 22, 25 and the limbs 21, 24. Further, the embossments "P", "R" are formed on the limbs 21, 24 wound with the coils with the longitudinal sides of the profile thereof orthogonal to the flowing magnetic fluxes $F_{10}$. As far as the embossments are formed in this way, the embossments may assume any shape.

Also, with the fixedly fitted surfaces of the embossments "O", "P", "Q", "R", the embossments formed on each lamination iron sheets may be sequentially overlaid and engaged with each other in a punch die and taken out in an integrated half-caulked state. The resulting assembly is pressured again in the direction of lamination again into a completely caulked state. As an alternative method, each lamination iron sheet formed with embossments may be punched and at the same time caulked completely in a die sequentially into complete products.

The advantage of the above-mentioned configuration will be explained below with reference to FIGS. 28(*a*) to 29(*b*).

Figure 28:
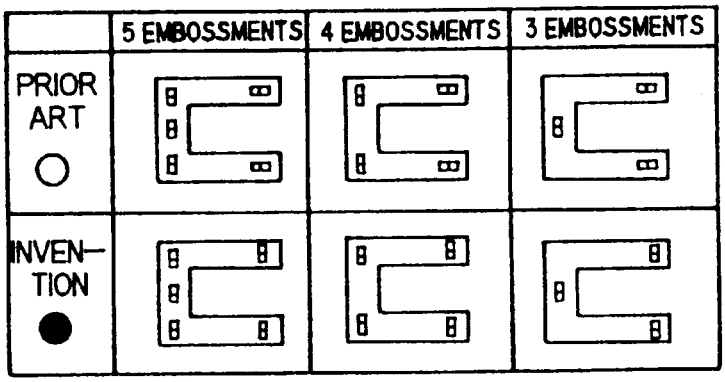
Figure 28:
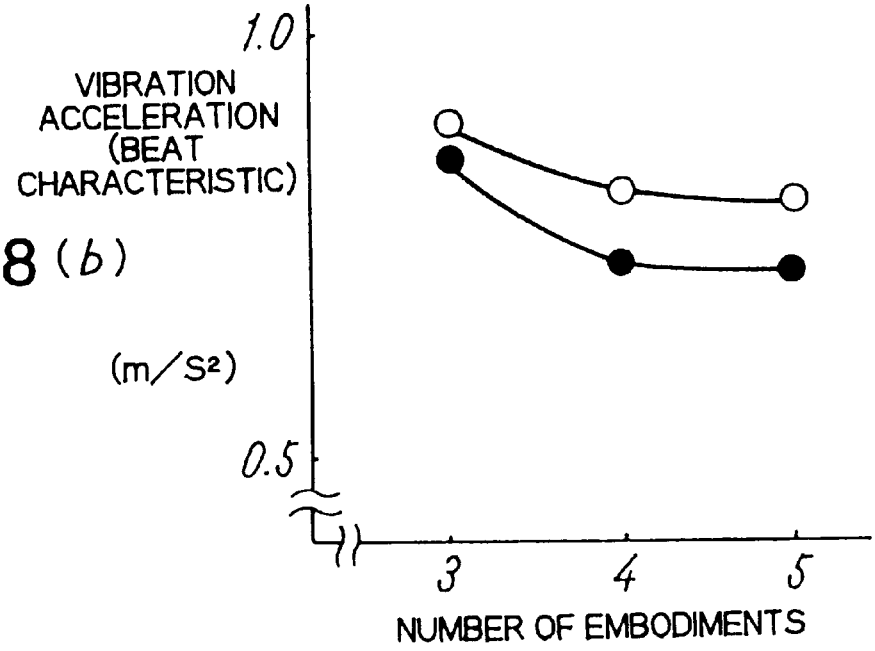

FIG. 28(*a*) is a model diagram showing laminated iron cores having embossments according to the prior art and those according to this embodiment. The embossments formed for the purpose of fixing laminated iron cores according to the prior art have the longitudinal sides of the profile thereof formed parallel to the magnetic fluxes in order to minimize the reduction in magnetic characteristics in view of the fact that the embossments increase the magnetic reluctance against the magnetic fluxes flowing in the laminated iron cores for deteriorated magnetic characteristics, make it necessary to increase the size of the choke coil to secure the required inductance, increase the loss for an increased temperature rise and increase leakage fluxes, resulting in deteriorated characteristics of the choke coil. In contrast, the embossments according to this embodiment have the longitudinal sides of the profile thereof formed orthogonal to the magnetic fluxes.

FIG. 28(*b*) shows the vibration acceleration (beat) of a magnetic core of a model choke coil sample in which the U-shaped iron cores laminated by the embossments make up a closed-circuit magnetic core with a magnetic gap formed, and a coil is wound on the limbs of the magnetic core.

Comparison shows that, the number of embossments being the same, the vibration acceleration of the laminated iron cores according to this embodiment is about 10% lower than that of the prior art. This indicates that the beat of the laminated iron cores can be effectively suppressed by the embossments according to the present embodiment. This is considered due to the stable structure (with a great vibration suppression ability) of the embossments that can be fixed with a large area with respect to the flow of magnetic fluxes, which embossments are formed on the limbs wound with the coil of a closed-circuit magnetic core made of laminated iron cores, i.e., where the magnetic flux density is highest in the laminated iron cores and there are generated magnetostrictive vibrations and normal vibrations in the direction of attraction by the excitation current constituting a cause of the beat.

This structure is very effective for a choke coil laden with the problem of beat of the magnetic core made of laminated iron cores such as those used for a choke coil for preventing harmonic distortions, in which the beat is caused by the magnetic fluxes induced by a large pulse input current flowing in the AC line.

It is feared, however, that the structure of the embossments according to the embodiment, in spite of a high vibration suppression ability thereof, may have the disadvantages of a considerably increased magnetic reluctance compared with the prior-art embossments against the magnetic fluxes flowing in the laminated iron cores, reduced magnetic characteristics, a reduced inductance required for the choke coil characteristics, an increased loss for a considerable temperature rise and increased leakage fluxes.

Figure 29:
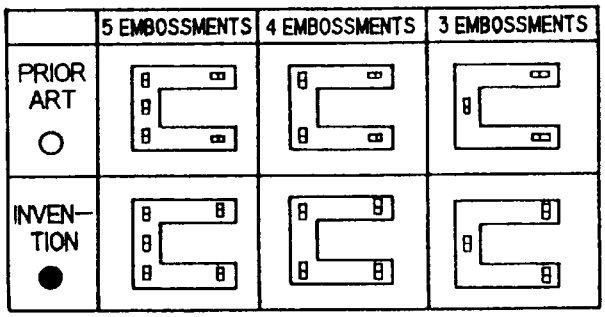
Figure 29:
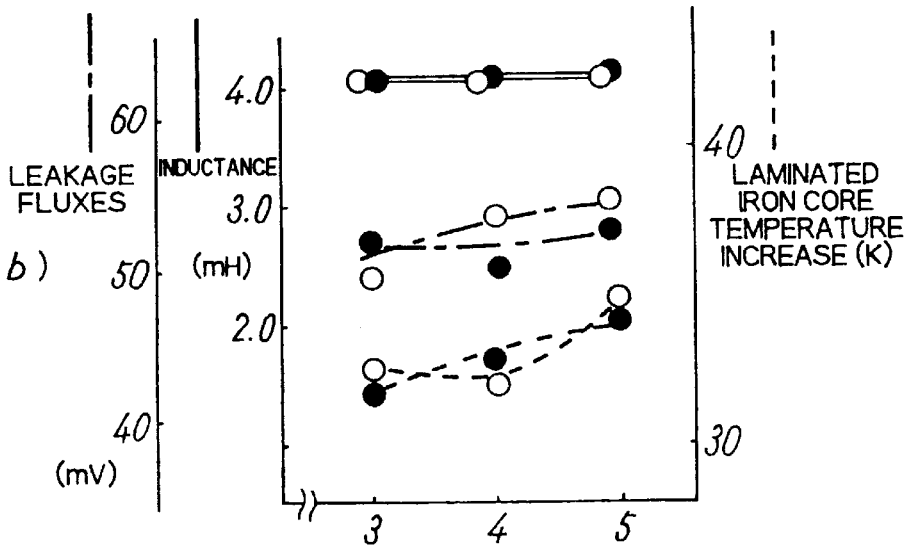

FIGS. 29(*a*) and 29(*b*) show the inductance value, the temperature increase of the laminated iron cores and the leakage fluxes of a choke coil sample identical to the one shown in FIG. 28.

It is seen that the inductance value, the temperature increase of the laminate iron cores and the leakage fluxes of a choke coil using the laminated iron cores according to the present embodiment as a magnetic core are substantially the same as those of the prior art. This is considered due to the fact that in the case of a choke coil requiring a magnetic gap to be formed in the magnetic paths of a closed-circuit magnetic core of laminated iron cores in order to improve the magnetic saturation characteristics, the magnetic characteristic of the laminated iron cores is determined by the particular magnetic gap. It thus became apparent that the characteristics of the choke coil are not deteriorated by the deterioration of the magnetic characteristic of the laminated iron cores according to the embodiment against our fear.

Further, in FIG. 28, it became obvious that the vibration acceleration (beat) of the laminated iron cores according to the present embodiment is substantially constant with four or more embossments and that the vibration acceleration of the laminated iron cores having four embossments according to the embodiment is smaller than that of the conventional one with five embossments.

From the above-mentioned fact, the number of embossments formed for the purpose of fixing the laminations of the laminated iron cores used for the choke coil according to the present embodiment is most appropriate and can display the advantage of coupling the laminated iron cores firmly.

It was feared that the arrangement and structure of the embossments having a great ability of suppressing magnetic vibrations may considerably increase the magnetic reluctance against the magnetic fluxes flowing in the laminated iron cores as compared with the conventional structure of embossments, and the resultant deterioration of the magnetic characteristics may necessitate a bulky structure in order to secure the required inductance, or increase the loss for an increased temperature, increase leakage fluxes or otherwise considerably deteriorate the choke coil characteristics. In spite of this fear, in the case of a choke coil requiring a magnetic gap for improving the magnetic saturation characteristic within the magnetic paths of the closed-circuit magnetic core made of laminated iron cores, the magnetic characteristics of the laminated iron cores are determined by the particular magnetic gap and therefore the deterioration of the characteristics is avoided.

In other words, an embossed protrusion structure which has so far been prohibited for the reason of characteristics in fixing a laminated iron core is positively introduced and optimized to obtain the advantage that the beats of the magnetic core can be reduced without deteriorating the choke characteristics.

Also, as shown in FIGS. 24(*b*) and 24(*c*), the sides of the embossments arranged longitudinally of the profile thereof for fitting and holding the cores are oriented necessarily in parallel to the end surfaces of the cores making up the magnetic gap 7. Even when the embossments "O", "P", "M", "N" are pressed without using any guide, therefore, there occurs any displacement toward the end surfaces and the gap accuracy can thus be secured. Further, in the case where the embossments "O" are formed on the two sides of the yoke 2 in inwardly-inclined fashion to each other as viewed from the window 23, the accuracy along the width of the limbs 21 can also be secured, thereby obviating such inconveniences as the limbs 21 being unable to be inserted into the bobbin.

Consequently, the choke coil using the laminated iron cores as a magnetic core having the arrangement and structure of embossments according to the present embodiment is low in cost and can reduce the beat.

Figure 30:
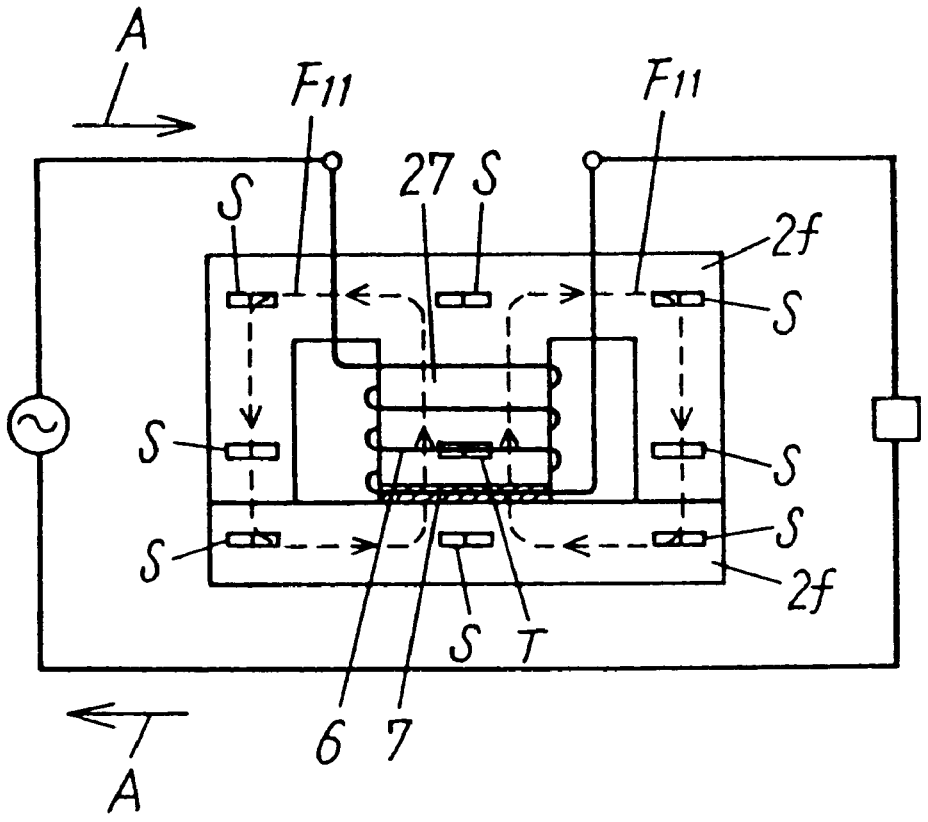
FIG. 30 is a diagram showing a magnetic circuit of the development example shown in FIG. 24(*a*)
Figure 31:
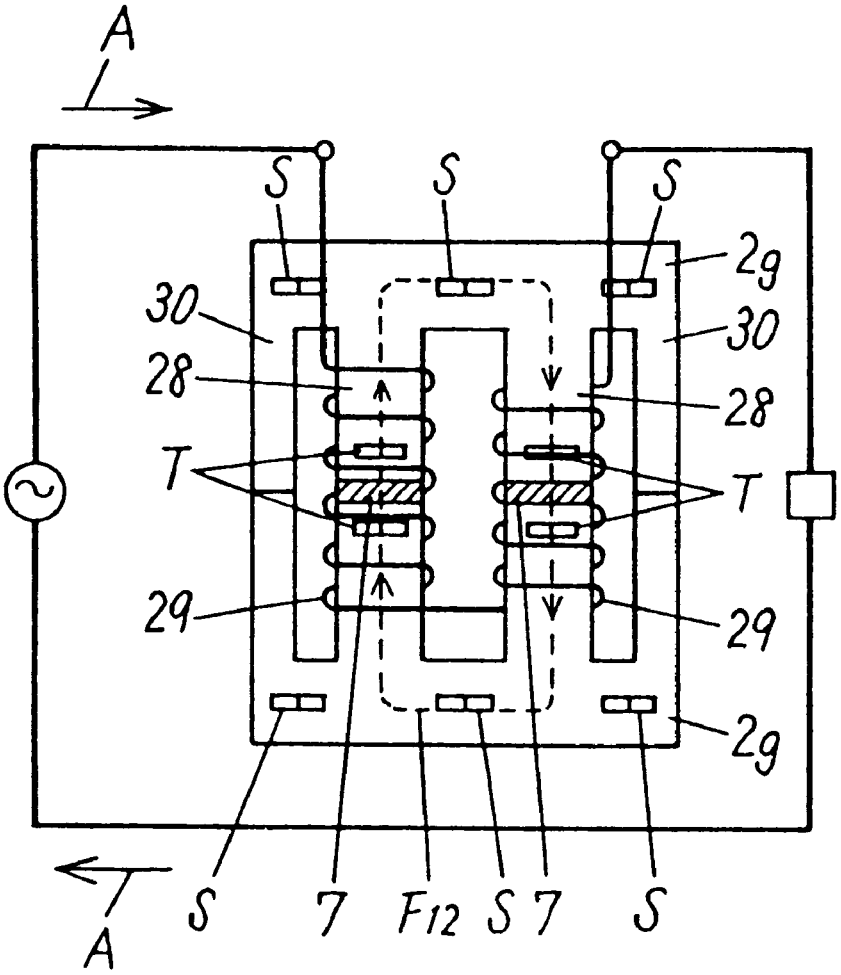
FIG. 31 is a diagram showing a magnetic circuit of the development example shown in FIG. 24(*a*)

This embodiment can be applied to any other embodiments that have laminated iron cores. FIGS. 30 and 31 show embodiments of such a choke coil. Explanation will be made in detail about these embodiments together with the shape of the laminated iron cores not yet described in the foregoing embodiments.

In FIG. 30, using a magnetic core 2*f* made of EI-shaped laminated iron cores fixed by punched-out protrusions "S", "T", a magnetic gap 7 is formed in the middle limb 27 of the E-shaped laminated iron cores for improving the magnetic saturation characteristic, thereby forming a closed-circuit magnetic core. A choke coil is completed by winding a coil 6 on the middle limb 27 of this magnetic core.

Now, by referring to FIG. 31, using a magnetic core 2*g* made of laminated iron cores in the shape of a triple-hung rectangle fixed by punched-out protrusions "S", "T", each magnetic gap 7 is formed between the butted surfaces of limbs 28 for improving the magnetic saturation characteristic, thereby forming a closed-circuit magnetic core. A choke coil is completed by winding a coil 29 on each of the limbs 28 of the magnetic core.

Side limbs 30 provide an additional magnetic path formed in order to pass leakage fluxes and discourage the generation of leakage fluxes to an external ambient.

The magnetic cores 2*f*, 2*g* made of laminated iron cores of the choke coils shown in FIGS. 30 and 31 respectively have the laminations thereof fixed by, for example, V-shaped embossments "S", "T" formed on the front and back of a multiplicity of iron core sheets punched into a predetermined shape. In either case, the embossments "T" are arranged in the magnetic path of the closed-circuit magnetic core wound with the coil and have the longitudinal sides of the profile thereof arranged orthogonally to the direction of the magnetic fluxes $F_{12}$ flowing in the magnetic path.

As described above, according to this embodiment, the embossments "S", "T" formed for fixing the laminations of the magnetic cores 2*e*, 2*g* made of laminated iron cores of a choke coil has the advantage of coupling the laminated iron cores firmly.

INDUSTRIAL APPLICABILITY

It will thus be understood from the foregoing description that according to the present invention there is provided a choke coil comprising a first magnetic core and a second magnetic core making up a closed magnetic circuit or an open magnetic circuit, a first coil, a second coil and a third coil, wherein the first coil is wound on the first magnetic core, the second coil is wound on the second magnetic core and further the third coil is wound in such a position as to cover the first and second magnetic cores. Therefore, (1) The inductance value for normal mode required for preventing harmonic distortions can be secured like the conventional choke coil for preventing harmonic distortions, and the function as a common-mode choke coil can be added at the same time.

(2) As a result, the common-mode choke coil thus far installed in the filter block of a power circuit for prevention of EMI as well as harmonic distortions can be eliminated, thereby saving the packaging space.

(3) Further, the common-mode choke coil section having a structure of upper and lower windings of the first and third coils has a higher coupling coefficient between the coils, thereby improving the magnetic saturation characteristic of the common-mode magnetic core.

(4) For this reason, the inductance value of the common-mode choke coil section can be set freely by changing the sectional area of the magnetic core without being affected by the number of turns or the setting of the magnetic circuit of the normal-mode choke coil section.

(5) Also, instead of a material low in magnetic permeability and high in saturation flux density used with the conventional choke coil for preventing harmonic distortions, a material of high permeability can be selected for the magnetic core of the common-mode choke coil section. Therefore, an inductance value of the common-mode choke coil section about two or three times larger than that of the prior art can be secured, thereby making it possible to reduce the size considerably.

(6) The high coupling coefficient can of course correspondingly reduce the leakage fluxes of the common-mode choke coil section, and the adverse effect on other parts can thus be prevented.

(7) In a core-type winding structure with second and third coils wound on each of the limbs of a magnetic core respectively, in a normal-mode choke coil section, the magnetic gap for improving the magnetic saturation characteristic of the normal-mode choke coil section is enclosed and is uniformly formed on the butted surfaces of the limbs. As a result, uniform magnetic fluxes are secured in the magnetic core, and leakage fluxes are considerably reduced.

(8) In the case of a choke coil comprising a common-mode choke coil section having a structure of upper and lower windings of first and third coils respectively and a normal-mode choke coil section having a core-type winding structure with the second and third coils, on the other hand, leakage fluxes can be reduced to about one fifth as compared with the conventional choke coil for preventing harmonic distortions without a shield case and to about one fourth as compared with a similar conventional choke coil having a shield case. As a consequence, the adverse effect on other parts and, in the case of television sets, the fatal picture fluctuations can be considerably prevented.

(9) In addition, the shield case conventionally used for preventing leakage fluxes can be eliminated, which in turn makes it possible to eliminate the insulating case and the casting resin, resulting in a considerable cost reduction and improved high-frequency characteristics. Also, with both the common- and normal-mode choke coil sections, the winding width of each coil can be accommodated in a single limb, and therefore the coil can be wound longer than in the prior art. In the case where a partitioned winding structure is employed, therefore, a multiple partitioned winding is made possible, thereby leading to a coil smaller in stray capacity and improved in high-frequency characteristics as compared with the prior art.

(10) Also, in the case of a choke coil with a magnetic core and a coil closely attached to each other without any air gap formed therebetween, the stray capacity is reduced and the frequency characteristic improved. At the same time, the temperature increase can be reduced for a reduced size, and the amount of copper wires used can be reduced, thereby realizing a superior choke coil.

(11) In the second magnetic core, the difference in length between the two limbs of the U-shaped iron core is set at least equal to the width of the yoke, and the width of the window is set at least equal to that of the limbs. Thus, the iron core band plate is punched out to secure a layout in which the shorter limb of one of two sheets as a set is combined with the window of the other sheet and all the limbs are parallel with respect to the direction of pressure-rolling the iron core band plate. The end surface of the limbs of the two U-shaped laminated iron core sheets as a set are butted against each other to form a closed magnetic circuit, thereby eliminating the punching loss of the U-shaped laminated iron core. Further, the band plate is punched out in a layout assuring the parallelism of all the limbs with respect to the direction of pressure-rolling the iron core band plate permits the laminating work on an automatic machine after punching, thereby leading to a very high producing efficiency. Also, with regard to the choke properties, as the direction of magnetic fluxes and the direction of pressure-rolling are the same in the limbs, there is the advantage of obtaining a large inductance.

(12) The resulting disruption of balance between the lengths of the two limbs, however, gave rise to the fear that the magnetic gap for generating fringing leakage fluxes may be displaced from the central portion of coil winding and that the leakage fluxes from the two limbs may fail to offset each other in a well-balanced fashion at the crossing point thereof. The leakage fluxes, however, can be considerably reduced by winding a coil on at least the butted portion of the two limbs. Thus a low-cost, high-quality choke coil can be provided without providing any expensive shield means.

This configuration of a U-shaped laminated iron core is not confined to the two-magnetic core three-windings type described above but is applicable also to any other choke coils using a magnetic core configured of laminated iron cores with a single-rectangle-shaped closed magnetic circuit.

(13) Further, consider a choke coil comprising a second magnetic coil in which iron core laminations are fixed by embossments and combined with a magnetic gap being formed to make up a closed-circuit magnetic core, the embossments are formed on the two sides of each yoke and the limbs wound with coils, and further the embossments in the limbs are arranged with the longitudinal sides of the profile thereof orthogonally to the direction of the magnetic fluxes flowing in the magnetic circuit. The embossments can be fitted and held each other with large side areas thereof facing each other in circuit portions wound with coils of the closed-circuit magnetic core made of laminated iron cores, i.e., the portions where the magnetic flux density is highest and the vibrations and magnetostrictive vibrations are easily generated in the direction of attraction by the excitation current causing the beat. The most stable arrangement and structure can thus be attained.

(14) The resulting advantage is that a small number of embossments formed for the purpose of fixing the laminations of the laminated iron cores can couple the laminated iron core sheets efficiently and firmly. Also, the sides of the embossments formed in the longitudinal direction of the profile thereof for fitting and holding themselves are necessarily arranged in parallel to the end surfaces of the cores making up a magnetic gap. Therefore, the gap accuracy can be secured even when the embossments are pressed without using any guide.

(15) This layout and structure of the embossments having a large power of suppressing magnetic vibrations gave rise to the fear that the magnetic reluctance against the magnetic fluxes flowing in the laminated iron cores may considerably increase as compared with the conventional embossment structure and the resulting reduced magnetic characteristics may make it necessary to increase the size of the choke coil in order to secure the required inductance, leading to an increased loss, an increased temperature, increased leakage fluxes or other considerable deterioration of the choke coil characteristics. Such a deterioration of the characteristics, however, can be prevented since in the case where a magnetic gap is required for improving the magnetic saturation characteristics in a magnetic path of a closed circuit magnetic core made of laminated iron cores, the magnetic characteristics of the laminated iron cores are determined by the particular magnetic gap.

(16) Furthermore, a choke coil using laminated iron cores characterized in that the embossments formed on the two sides of the yoke are oriented in the shape of mutually inwardly inclined fashion as viewed from the window can also secure the accuracy along the width of the limbs.

The configuration of the embossments is not limited to the one with two magnetic cores and three windings described above, but can be applied to any other choke coils comprising a magnetic core configured of laminated iron cores.

These great advantages are obtained, and therefore a compact, high-performance and high-quality choke coil can be provided at low cost with a high industrial value.

LIST OF REFERENCE NUMERALS

| | |
|---|---|
| 1 | First magnetic core |
| 1a | First magnetic core |
| 2 | Second magnetic core |
| 2a | Second magnetic core |
| 2b | Second magnetic core |
| 2c | Second magnetic core |
| 2c1 | U-shaped iron core |
| 2d | Magnetic core |
| 2e | Second magnetic core |
| 2f | Magnetic core |
| 2g | Magnetic core |
| 3 | Coil |
| 3a | First coil |
| 4 | Coil |
| 5 | Coil |
| 4a | Second coil |
| 5a | Third coil |
| 5b | Third coil |
| 5c | Third coil |
| 6 | Third coil |
| 7 | Magnetic gap |
| 8 | Bobbin |
| 8a | Bobbin |
| 9 | Bobbin |
| 9a | Bobbin |
| 10 | Bobbin |
| 10a | Bobbin |
| 11 | Support member |
| 12 | Pilot hole |
| 13 | Caulking seperation hole |
| 14 | Caulked protrusions |
| 15 | Permanent magnet |
| 16 | Stopper |
| 17 | Limb |
| 18 | Limb |
| 19 | Yoke |
| 20 | Window |
| 21 | Limb |
| 22 | Yoke |
| 23 | Window |
| 24 | Limb |
| 25 | Yoke |
| 26 | Magnetic core |
| 27 | Middle limb |
| 28 | Limb |
| 29 | Coil |
| 30 | Side limb |
| 58 | Magnetic core |

-continued

LIST OF REFERENCE NUMERALS

| | |
|---|---|
| 59 | Magnetic core |
| 60 | Bobbin |
| 61 | Coil |
| 62 | Coil |
| 63 | Resin case |
| 64 | Shield case |
| 65 | Casing resin |
| 66 | partitioning flange |
| 67 | Magnetic gap |
| A | Line current |
| C | Common-mode choke coil section |
| N | Normal-mode choke coil section |
| O | Embossment |
| P | Embossment |
| Q | Embossment |
| R | Embossment |
| S | Embossment |
| T | Embossment |
| $F_1$ | Magnetic flux |
| $F_2$ | Magnetic flux |
| $F_3$ | Magnetic flux |
| $F_4$ | Magnetic flux |
| $F_5$ | Magnetic flux |
| $F_6$ | Magnetic flux |
| $F_7$ | Magnetic flux |
| $F_8$ | Magnetic flux |
| $F_9$ | Magnetic flux |
| $F_{10}$ | Magnetic flux |
| $F_{11}$ | Magnetic flux |
| $F_{12}$ | Magnetic flux |

What is claimed is:

1. A choke coil comprising a first magnetic core having first and second limbs, a second magnetic core having first and second limbs, a first coil, a second coil and a third coil, said first magnetic core making up a closed magnetic circuit, wherein:

said first coil is wound on the first limb of said first magnetic core;

said first coil is wound on the first limb of said second magnetic core;

said second magnetic core is located inside the magnetic circuit of said first magnetic core;

said third coil is wound in such a manner as to cover the second limb of said first magnetic core and the second limb of said second magnetic core;

said first and third coils are wound in such a direction that magnetic fluxes of said first and third coils with respect to a line current in said choke coil are offset in the magnetic circuit of said first magnetic core, whereby a common-mode choke coil section is constituted; and said second and third coils are wound in such a direction that magnetic fluxes of said second and third coils with respect to said line current are offset in the magnetic circuit of said second magnetic core, whereby a normal-mode choke coil section is constituted.

2. A choke coil according to claim 1, wherein:

said second magnetic core comprises a plurality of U-shaped laminated magnetic cores, each comprising a plurality of sheets having limbs and a window; and a difference in length between the limbs of each of said U-shaped laminated magnetic cores is set to at least equal to a yoke width of said each of said U-shaped laminated magnetic cores;

a window width of said each of said U-shaped laminated magnetic core is set to at least equal to a width of said limbs of said U-shaped laminated magnetic core;

said sheets are laid out and punched out from an iron core band plate in such a manner that a shorter one of said limbs of one of said sheets meshes with said window of another of said sheets and all the limbs of said sheets are parallel with respect to a direction of pressure-rolling of said iron core band plate;

end surfaces of the limbs of said plurality of U-shaped laminated iron cores are butted against each other to form a closed magnetic circuit with a butted portion; and said second and third coils are wound at least on the butted portion.

3. A choke coil according to claim 1 wherein:

said second magnetic core comprises:

(a) a single rectangular-shaped closed circuit magnetic core comprising a plurality of U-shaped laminated magnetic cores, each comprising a plurality of sheets with limbs, a yoke and a window;

a difference in length between said limbs of said each of said U-shaped laminated magnetic cores being not smaller than a width of said yoke;

a width of said window being not smaller than a width of each of said limbs;

said sheets being laid out and punched out from an iron core band plate such that a shorter one of said limbs of one of said sheets meshes with the window of another one of said sheets, and all of said limbs are parallel with respect to a direction of pressure-rolling of said iron core band plate;

end surfaces of said limbs of said U-shaped laminated iron cores being butted against each other to form a closed magnetic circuit with a butted portion; and (b) said second and third coils being wound on at least the butted portion.

4. A choke coil comprising:

a closed circuit magnetic core including a plurality of laminated iron core sheets formed in a predetermined shape and defining a magnetic gap, and a coil wound on said plurality of laminated iron core sheets, said laminated iron core sheets having front and rear sides provided with embossments for fitting and holding said laminated iron core sheets together, said embossments being formed in a magnetic path of said closed circuit magnetic core, and at least some of said embossments having longitudinal sides formed orthogonal to a direction of magnetic fluxes flowing in said magnetic path.

5. A choke coil according to claim 4, wherein said laminated iron core sheets comprise a pair of limbs having said coil wound thereon and a yoke; said embossments are formed on each of two sides of said yoke and on said limbs; and said at least some of said embossments have longitudinal sides oriented orthogonally to said direction of said magnetic fluxes flowing in said magnetic path are formed on said limbs.

6. A choke coil according to claim 5, wherein:

said pair of limbs and said yoke form a window in said closed circuit magnetic core; and said embossments formed on said two sides of said yoke are oriented in an inwardly-inclined direction relative to each other, as viewed from said window in said closed circuit magnetic core.

7. A choke coil comprising:

a power source for generating a line current;

a first magnetic core having limbs;

a second magnetic core having limbs;

a first coil wound on one of the limbs of said first magnetic core for generating a first magnetic flux in a first direction in the limbs of said first magnetic core by the line current;

a second coil wound on one of the limbs of said second magnetic core for generating a second magnetic flux in a second direction in the limbs of said second magnetic core by the line current; and a third coil wound to cover said one of the limbs of said first magnetic core which is wound with said first coil for generating a third magnetic flux in a third direction which is opposite to the first direction in the limbs of said first magnetic core by the line current and to cover a portion of said second magnetic core for generating a fourth magnetic flux in the second direction in the limbs of said second magnetic core by the line current;

wherein said second magnetic core comprises:

(a) a single rectangular-shaped closed circuit magnetic core comprising a plurality of U-shaped laminated magnetic cores, each comprising a plurality of sheets with limbs, a yoke and a window;

a difference in length between the limbs of said each of said U-shaped laminated magnetic cores being set not smaller than a width of said yoke;

a width of said window being set not smaller than a width of each of the limbs;

said sheets being laid out and punched out from an iron core band plate such that a shorter one of the limbs of one of said sheets meshes with the window of another one of said sheets, and all of the limbs are parallel with respect to a direction of pressure-rolling of said iron core band plate;

end surfaces of the limbs of said U-shaped laminated iron cores being butted against each other to form a closed magnetic circuit with a butted portion; and (b) said second coil and said third coil being wound at least on the butted portion.

8. A choke coil according to claim 7 wherein:

each of said first magnetic core and said second magnetic core comprises a single rectangular-shaped closed-circuit magnetic core having said limbs; and said third coil is wound to cover said one of the limbs of said first magnetic core wound with said first coil and to cover said one of the limbs of said second magnetic core wound with said second coil.

9. A choke coil according to claim 7 wherein:

each of said first and second magnetic cores comprises a single rectangular-shaped closed-circuit magnetic core and said limbs of each of said first and second magnetic cores comprise first and second limbs;

said first coil is wound on said first limb of said first magnetic core for generating the first magnetic flux in the first direction in said first limb of said first magnetic core by the line current applied to the choke coil;

said second coil is wound on said first limb of said second magnetic core for generating the second magnetic flux in the second direction in said first limb of the second magnetic core by the line current applied to the choke coil; and the third coil is wound to cover said second limb of said second magnetic core and said first limb of said first magnetic core wound with said first coil for generating said third magnetic flux in the third direction opposite to the first direction and said fourth magnetic flux in the second direction in said second limb of said second magnetic core by the line current.

* * * * *

UNITED STATES PATENT AND TRADEMARK OFFICE

CERTIFICATE OF CORRECTION

PATENT NO. : 6,014,071
DATED : January 11, 2000
INVENTOR(S) : Kazuaki Onishi et al.

It is certified that error appears in the above-identified patent and that said Letters Patent is hereby corrected as shown below:

Under "Related U.S. Application Data" it should read:

[62] Division of application No. 08/553,506, Nov. 30, 1995, Pat. No. 5,841,335, which is a 371 of PCT/JP95/00790, filed Apr. 21, 1995.

Signed and Sealed this

Fifteenth Day of January, 2002

*Attest:*

*Attesting Officer*

JAMES E. ROGAN
*Director of the United States Patent and Trademark Office*